US007862976B2

(12) United States Patent
Miura et al.

(10) Patent No.: US 7,862,976 B2
(45) **Date of Patent: *Jan. 4, 2011**

(54) LIQUID DEVELOPER AND IMAGE FORMING APPARATUS

(75) Inventors: Satoru Miura, Matsumoto (JP); Koji Akioka, Matsumoto (JP); Hiroshi Kaiho, Matsumoto (JP); Takashi Teshima, Shiojiri (JP); Ken Ikuma, Suwa (JP)

(73) Assignee: Seiko Epson Corporation, Tokyo (JP)

( * ) Notice: Subject to any disclaimer, the term of this patent is extended or adjusted under 35 U.S.C. 154(b) by 348 days.

This patent is subject to a terminal disclaimer.

(21) Appl. No.: 11/777,197

(22) Filed: Jul. 12, 2007

(65) Prior Publication Data

US 2008/0014526 A1 Jan. 17, 2008

(30) Foreign Application Priority Data

| | | |
|---|---|---|
| Jul. 13, 2006 | (JP) | 2006-193426 |
| Jul. 13, 2006 | (JP) | 2006-193427 |
| Jul. 21, 2006 | (JP) | 2006-200082 |
| Jul. 21, 2006 | (JP) | 2006-200083 |
| Mar. 26, 2007 | (JP) | 2007-080366 |

(51) Int. Cl.
*G03G 5/00* (2006.01)

(52) U.S. Cl. ..... 430/115; 430/116; 399/237

(58) Field of Classification Search ..... 430/115, 430/116; 399/237
See application file for complete search history.

(56) References Cited

U.S. PATENT DOCUMENTS 7,595,140 B2 * 9/2009 Akioka et al. ..... 430/116

FOREIGN PATENT DOCUMENTS

JP 07-152256 6/1995

* cited by examiner

*Primary Examiner*—Mark A Chapman
(74) *Attorney, Agent, or Firm*—DLA Piper LLP (US)

(57) ABSTRACT

A liquid developer having superior fixing characteristic of toner particles to a recording medium and which is harmless to the environment, and an image forming apparatus using the liquid developer are provided. The liquid developer is comprised of an insulation liquid and toner particles dispersed in the insulation liquid, wherein the insulation liquid contains a first vegetable oil and a reaction product produced by an ester exchange reaction of a second vegetable oil and a monovalent alcohol.

16 Claims, 8 Drawing Sheets

LIQUID DEVELOPER AND IMAGE FORMING APPARATUS

CROSS-REFERENCE TO RELATED APPLICATION

This application claims priorities to Japanese Patent Applications No. 2006-193426 and No. 2006-193427 both filed on Jul. 13, 2006, No. 2006-200082 and No. 2006-200083 both filed on Jul. 21, 2006, and No. 2007-080366 filed on Mar. 26, 2007 which are hereby expressly incorporated by reference herein in their entireties.

BACKGROUND

1. Technical Field

The present invention relates to a liquid developer and an image forming apparatus.

2. Related Art

As a developer used for developing an electrostatic latent image formed on a latent image carrier, there are known two types. One type of such a developer is known as a dry toner which is formed of a material containing a coloring agent such as a pigment or the like and a binder resin, and such a dry toner is used in a dry condition thereof.

The other type of such a developer is known as a liquid developer (liquid toner) which is obtained by dispersing toner particles into a carrier liquid having electric insulation properties (one example of such a liquid developer is disclosed in JP-A-7-152256).

In the developing method using such a dry toner, since a solid state toner is used, there is an advantage in handleability thereof. On the other hand, however, this method involves problems in that an adverse effect against a human body is likely to be caused by toner powder, contamination is likely to be caused by dispersal of toner powder, and toner particles are likely to be massed together in a cartridge.

Further, in such a dry toner, since aggregation of toner particles is likely to occur in the producing process thereof, it is difficult to obtain toner particles each having a sufficiently small diameter. This means that it is difficult to form a toner image having high resolution.

Furthermore, there is also a problem in that when the size of the toner particle is made to be relatively small, the problems resulted from the powder form of the dry toner described above become more serious.

On the other hand, in the developing method using the liquid developer, since aggregation of toner particles in the liquid developer is effectively prevented, it is possible to use very fine toner particles and it is also possible to use a binder resin having a low softening point (a low softening temperature).

As a result, the method using the liquid developer has such advantages as good reproducibility of an image composed of thin lines, good tone reproducibility as well as good reproducibility of colors. Further, the method using the liquid developer is also superior as a method for forming an image at high speed.

However, since the insulation liquid used in the conventional liquid developer is mainly composed of a petroleum-based carbon hydride, there is concern that the insulation liquid may give an adverse effect on the environment if it flows out of an image forming apparatus.

Further, normally, when a liquid developer is used, an insulation liquid is adhering to a surface of each toner particle during fixing process of the toner particles. Because of this, in the conventional liquid developer, there is a problem in that such an insulation liquid adhering to the surfaces of the toner particles lowers fixing strength of the toner particles to a recording medium.

In this regard, in order to improve the fixing strength of the toner particles, it may be conceived that the toner particles are heated for a long period of time at a relatively high temperature. However, this approach makes it difficult to satisfy recent demands required in the field of image formation such as higher speed image formation and image formation under energy saving.

SUMMARY

Accordingly, it is an object of the present invention to provide a liquid developer which has superior fixing characteristic of toner particles to a recording medium and which is harmless to the environment, and an image forming apparatus using the liquid developer.

These objects are achieved by the present invention described below. In one aspect of the present invention, there is provided a liquid developer which comprises an insulation liquid and toner particles dispersed in the insulation liquid, wherein the insulation liquid comprises a first vegetable oil and a reaction product produced by an ester exchange reaction of a second vegetable oil and a monovalent alcohol.

In the liquid developer according to the present invention, it is preferred that the kind of the second vegetable oil is different from the kind of the first vegetable oil.

In the liquid developer according to the present invention, it is preferred that the first vegetable oil is rape oil and the second vegetable oil is soy oil.

In the liquid developer according to the present invention, it is preferred that the first vegetable oil is soy oil and the second vegetable oil is rape oil.

In the liquid developer according to the present invention, it is preferred that the insulation liquid further contains a dispersant comprised of a condensation polymer of polyamine fatty acid.

In the liquid developer according to the present invention, it is preferred that the first vegetable oil and the second vegetable oil are the same kind vegetable oil, and the insulation liquid further contains a condensation polymer of polyamine fatty acid as a dispersant.

In the liquid developer according to the present invention, it is preferred that both the first and second vegetable oils are soy oil.

In the liquid developer according to the present invention, it is preferred that both the first and second vegetable oils are rape oil.

In the liquid developer according to the present invention, it is preferred that an amount of the condensation polymer of polyamine fatty acid is 0.5 to 7.5 parts by weight with respect to 100 parts by weight of the toner particles.

In the liquid developer according to the present invention, it is preferred that when an amount of the first vegetable oil contained in the insulation liquid is defined as X wt % and an amount of the reaction product is defined as Y wt %, the relation: $0.1 \leqq X/Y \leqq 9$ is satisfied.

In the liquid developer according to the present invention, it is preferred that the reaction product is produced by an ester exchange reaction of the second vegetable oil and a monovalent alcohol having 1 to 4 carbon atoms.

In the liquid developer according to the present invention, it is preferred that the viscosity of the liquid developer which is measured according to JIS Z8809 using a vibration type viscometer at a temperature of 25° C. is in the range of 50 to 1000 mPa·s.

In the liquid developer according to the present invention, it is preferred that a resin material which constitutes the toner particles is polyester resin.

In the liquid developer according to the present invention, it is preferred that the insulation liquid further contains a metal oxide, and an amount of the metal oxide is 0.5 to 4.0 parts by weight with respect to 100 parts by weight of the toner particles.

In another aspect of the present invention, there is provided an image forming apparatus, comprising:

a plurality of developing sections for forming a plurality of monochromatic color images using a plurality of liquid developers of different colors;

an intermediate transfer section to which a plurality of monochromatic color images formed by the developing sections are sequentially transferred to form an intermediate transfer image which is formed by overlaying the transferred monochromatic color images one after another;

a secondary transfer section for transferring the intermediate transfer image onto a recording medium to form an unfixed image onto the recording medium, and a fixing device for fixing the unfixed image onto the recording medium, wherein each of the liquid developers of the different colors comprises an insulation liquid and toner particles dispersed in the insulation liquid, wherein the insulation liquid comprising a first vegetable oil and a reaction product produced by an ester exchange reaction of a second vegetable oil and a monovalent alcohol.

In the image forming apparatus according to the present invention, it is preferred that each of the plurality of developing sections includes a developing roller having a surface on which a layer of the liquid developer is to be formed, and a photoreceptor having a surface on which the corresponding monochromatic color image is to be formed by transferring the liquid developer on the developing roller, wherein the surface of the photoreceptor is formed of amorphous silicon.

According to the invention as described above, it is possible to provide a liquid developer which has superior fixing characteristic of toner particles to a recording medium and is harmless to the environment.

Further, it is also possible to provide an image forming apparatus using the liquid developer.

DESCRIPTION OF EXEMPLARY EMBODIMENTS

Figure 1:
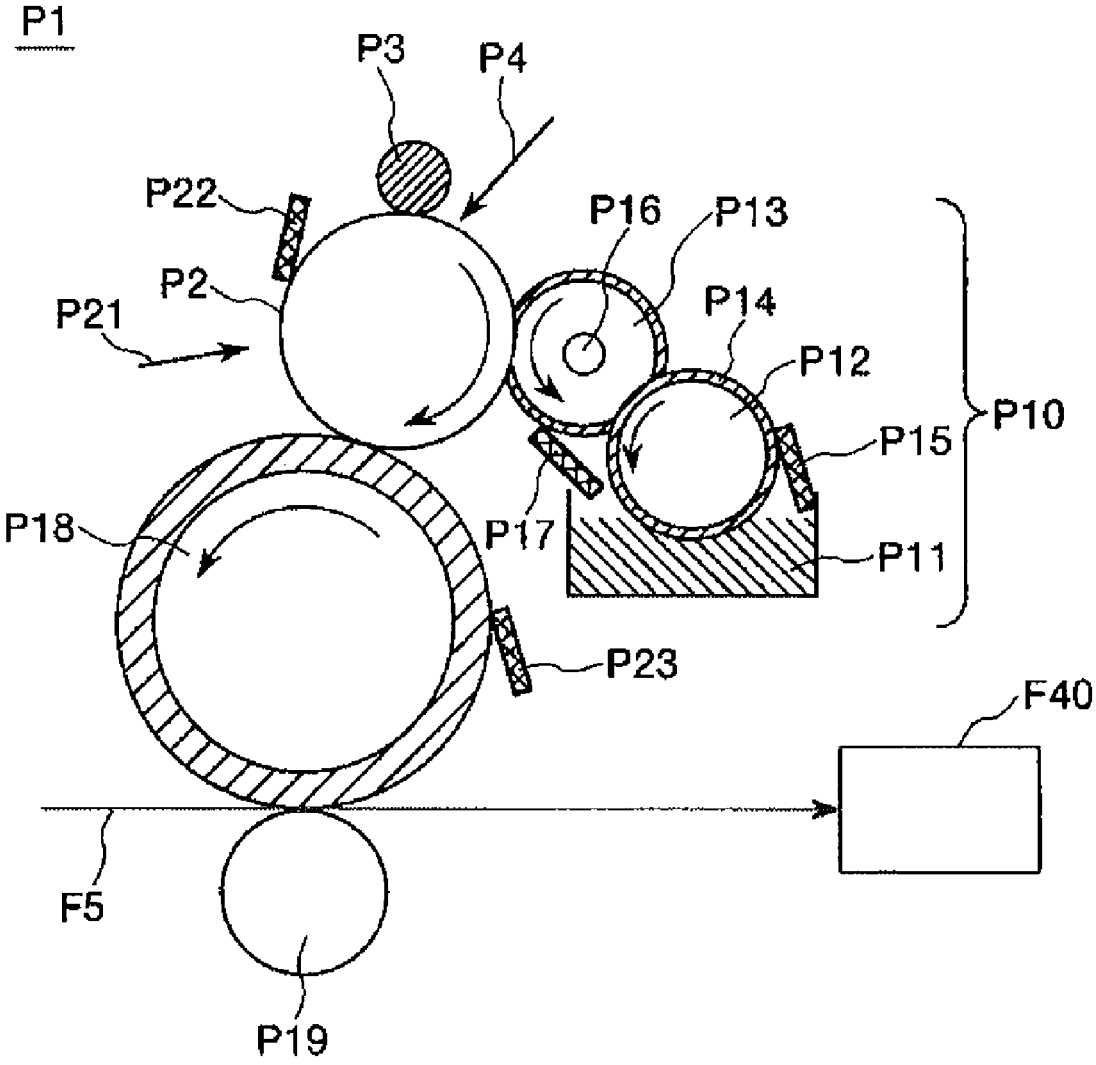
FIG. 1 is an illustration which shows one example of a contact type image forming apparatus to which the liquid developer of the present invention can be used.

Hereinbelow, with reference to the accompanying drawings, preferred embodiments of a liquid developer and an image forming apparatus according to the invention will be described in details.

<<Liquid Developer>>

First, a description will be made with regard to the liquid developer of the present invention. The liquid developer of the invention includes an insulation liquid and toner particles dispersed in the insulation liquid.

<Insulation Liquid>

First, a description will be made with regard to the insulation liquid.

The insulation liquid of the invention includes a first vegetable oil and a reaction product obtained by an ester-exchange reaction of a second vegetable oil and a monovalent alcohol.

In the following description, the first vegetable oil is also referred to as a vegetable oil, and the reaction product obtained by the ester-exchange reaction of the second vegetable oil and the monovalent alcohol is also referred to as a vegetable oil-alcohol ester-exchange liquid.

As described above, in the conventional liquid developer, there is concern that an insulation liquid may give an adverse affect on the environment due to leakage of the insulation liquid out of an image forming apparatus during use (e.g. volatilization of an insulation liquid during a fixing process) and discard of the used liquid developer.

Further, in the conventional liquid developer, there is also a problem in that such an insulation liquid adhering to the surfaces of the toner particles lowers fixing strength of the toner particles to a recording medium.

In contrast with the conventional liquid developer described above, both the vegetable oil and the vegetable oil-alcohol ester-exchange liquid used in the insulation liquid of the liquid developer of the present invention are components harmless to the environment.

Therefore, it is possible to decrease a load to the environment by the insulation liquid which may be cased by leakage of the insulation liquid out of the image forming apparatus and discard of the used liquid developers. As a result, it is also possible to provide a liquid developer which is harmless to the environment.

In addition, the vegetable oil-alcohol ester-exchange liquid is mainly constituted from a fatty acid monoester, and such a fatty acid monoester has a property that is easily impregnated into the inside of the toner particle (resin material), so that it has an effect capable of plasticizing the toner particles appropriately during the fixing process. Because of the plasticizing effect, when a paper is used as a recording medium, for example, the toner particles easily enter into gaps of paper fibers of the paper so that the fixing property between the paper and the toner particles can be made excellent.

Further, because of this plasticizing effect, the toner particles are fused at a relatively low temperature and can be fixed onto the recording medium in such a fused state. Therefore, the liquid developer using the insulation liquid containing such a vegetable oil-alcohol ester-exchange liquid can be appropriately used in high speed image formation at a relatively low temperature.

Further, since the vegetable oil-alcohol ester-exchange liquid is a component which is easily impregnated into a recording medium, the vegetable oil-alcohol ester-exchange liquid adhering to the surfaces of the toner particles is immediately impregnated into the recording medium when the toner particles make contact with the recording medium during the fixing process.

Further, the vegetable oil-alcohol ester-exchange liquid has a high affinity with the resin component contained in the toner particles. Therefore, when the vegetable oil-alcohol ester-exchange liquid itself is impregnated into the recording medium, the vegetable oil-alcohol ester-exchange liquid drags a part of each toner particle (that is, the resin component contained in the toner particles), which has been plasticized by the plasticizer effect and fused by heat upon fixation, into the recording medium.

Namely, a part of the resin component is also impregnated into the recording medium together with the vegetable oil-alcohol ester-exchange liquid. The impregnated resin component exhibits an anchoring effect against the recording medium to thereby further enhance the fixing strength of the toner particles against the recording medium.

The above mentioned specific effects are exhibited by the use of the insulation liquid which contains both the vegetable oil and the vegetable oil-alcohol ester-exchange liquid. In this connection, it should be noted that in the case where the insulation liquid does not contain both of these components, the effects of the present invention can not be obtained.

Specifically, in the case where the insulation liquid does not contain the vegetable oil, the vegetable oil-alcohol ester-exchange liquid which is a low molecular component and has low viscosity is easily impregnated into the toner particles, and thus the plasticizing effect described above will be exhibited during the preservation of the liquid developer.

As a result, aggregation of the toner particles is likely to occur, and thus it is difficult to provide a liquid developer having sufficient preservability and storage stability. On the other hand, in the case where the insulation liquid does not contain the vegetable oil-alcohol ester-exchange liquid, the plasticizing effect of the insulation liquid against the toner particles become insufficient and the impregnation of the insulation liquid into the recording medium is difficult to occur, and as a result, sufficient fixing strength of the toner particles against the recording medium can not be obtained.

Further, in the case where the vegetable oil and the vegetable oil-alcohol ester-exchange liquid contain an unsaturated fatty acid component, the following effects can be obtained.

The unsaturated fatty acid component is a component that can contribute to improving fixing properties of toner particles to a recording medium.

More specifically, the unsaturated fatty acid component is a component which is polymerized when oxidized (during the fixing process), and thus the unsaturated fatty acid component is a component which has a function of improving the fixing properties of the toner particles against a recording medium when it is cured. Due to such a function, the liquid developer of the present invention makes it possible to improve the fixing properties of the toner particles against a recording medium.

Furthermore, since the unsaturated fatty acid component is cured, it is possible to write letters or the like onto the fixed toner image with a ballpoint pen using a water-based ink easily and reliably.

In particular, by using the insulation liquid containing both the vegetable oil and the vegetable oil-alcohol ester-exchange liquid like the present invention, the liquid developer can have especially excellent fixing strength. This feature is supposed to result from the following reasons.

Namely, in general, a vegetable oil-alcohol ester-exchange liquid has lower viscosity rather than vegetable oils. Therefore, when the insulation liquid contains both the vegetable oil and the vegetable oil-alcohol ester-exchange liquid, it is possible to adjust the viscosity of the insulation liquid and the liquid developer to a desired level so that the liquid developer can be impregnated into a recording medium appropriately.

Further, when the unsaturated fatty acid component contained in the insulation liquid is oxidized, the insulation liquid is cured in a state that it contains toner particles to thereby exhibit an anchoring effect between the cured liquid developer and a recording medium, and as a result thereof it becomes possible to fix the toner particles against the recording medium firmly.

Further, a vegetable oil is constituted from a triester (fatty acid triglyceride) which is formed by a reaction of one molecular of glycerine and three moleculars of fatty acid. Also, as described above, the vegetable oil-alcohol ester-exchange liquid is mainly constituted from a fatty acid monoester.

Generally, a polymerized product constituted from a fatty acid monoester and a fatty acid triglyceride is likely to have a large molecular weight as compared to a polymerized product constituted by oxidation polymerization of only a fatty acid monoester.

Therefore, in the case of an insulation liquid containing both the fatty acid monoester (vegetable oil-alcohol ester-exchange liquid) and the fatty acid triglyceride (vegetable oil), the molecular weight of a polymerized product becomes larger.

As a result, the anchoring effect between the recording medium and the cured liquid developer also becomes larger, and thus the fixing strength of the toner particles against a recording medium also becomes excellent. In addition, the polymerized product constituted from the fatty acid monoester and the fatty acid triglyceride can be cured in a relatively short period of time.

Therefore, in the case of an insulation liquid containing both the vegetable oil and the vegetable oil-alcohol ester-exchange liquid, a time it takes from a liquid state to a solid state thereof (cured state) is shorter than the case where an insulation liquid contains only a vegetable oil-alcohol ester-exchange liquid. Therefore, the liquid developer of the present invention can be used for high speed image formation suitably.

On the other hand, in the case where the insulation liquid is constituted from only the vegetable oil without containing the vegetable oil-alcohol ester-exchange liquid, impregnation of the liquid developer into a recording medium becomes insufficient, and thus it is not possible to make the fixing strength of the toner particles against a recording medium sufficiently high, though a polymerized product can have large molecular weight. Further, such a liquid developer can not be suitably used for high speed image formation.

In the case where the insulation liquid contains both the vegetable oil and the vegetable oil-alcohol ester-exchange liquid, since a polymerized product produced after the polymerization reaction has an increased mechanical strength, the fixing strength of the toner particles against a recording medium becomes especially excellent.

This is supposed to result from the reason that the fatty acid triglyceride contains a plurality of fatty acid components and thus the fatty acid components are likely to interweave with a fatty acid component of the fatty acid monoester and a fatty acid component of other fatty acid triglyceride during the oxidation polymerization process.

Further, in the case of the conventional liquid developer using an insulation liquid constituted from a petroleum-based carbon hydride (in many cases, isoparaffin-based solvent), the fixing property of the toner particles to a recording medium becomes worse if the solvent is removed during the fixing process.

In contrast, in the liquid developer of the present invention using the insulation liquid containing both the vegetable oil and the vegetable oil-alcohol ester-exchange liquid, since the insulation liquid itself is cured during the fixing process, it is possible to make the fixing property of the toner particles to a recording medium more excellent.

Further, in the case of the liquid developer of the present invention using the insulation liquid containing both the vegetable oil and the vegetable oil-alcohol ester-exchange liquid, it is possible to make dispersion stability of the toner particles sufficiently high to thereby make preservability and storage stability of the liquid developer excellent. This is supposed to result from the following reasons.

The fatty acid monoester and the fatty acid triglyceride contained in the insulation liquid have high affinity against the resin material which is a main component of the toner particles.

In particular, since the fatty acid triglyceride has high viscosity and has a structure with a plurality of fatty acid components, it has excellent adsorptive property to the surfaces of the toner particles, and therefore the fatty acid triglyceride exhibits an effect as a dispersant while possessing a property as a dispersion medium for the toner particles.

Accordingly, in the liquid developer of the present invention, the fatty acid triglyceride exists in the insulation liquid in a state that a part thereof is adsorbed to the surfaces of the toner particles, so that aggregation (blocking) of the toner particles can be effectively prevented, thereby enabling the above effects to be exhibited.

Examples of the first vegetable oil and second vegetable oil include naturally derived vegetable oils such as rape oil, soy oil, safflower oil, sunflower oil, linseed oil, cotton seed oil, dewatered ricinus oil, palm oil, palm kernel oil, coconut oil and the like. These oils may be used as they are or after they have been refined.

As for the method for refinement of the oils, the following method can be mentioned, for example. First, unrefined oil is mixed with boiled water. After the mixture is completely separated into three layers, it is frozen in a freezer, and then frozen components are removed.

The vegetable oil-alcohol ester-exchange liquid is a reaction product produced by an ester-exchange reaction of the vegetable oil mentioned above and a monovalent alcohol, and the liquid is mainly comprised of a fatty acid monoester. As for the monovalent alcohol, various types may be used, but a monovalent alcohol having 1 to 4 carbon atoms is preferably used.

By using such a reaction product, the effects described above are exhibited conspicuously and impregnability of the insulation liquid to a recording medium becomes higher, thereby enabling the fixing property of the liquid developer of the present invention to be excellent.

The kind of the first vegetable oil and the kind of the second vegetable oil may be the same as to each other or different from to each other.

When the kind of the first vegetable oil is different from the kind of the second vegetable oil, adjustment of the viscosity of the insulation liquid can be made easily by selecting kinds of vegetable oils to be used. This makes it possible to provide a liquid developer having excellent preservability or to provide a liquid developer having excellent fixing property with the preservability and the fixing property being kept at practical levels.

Further, in the case where the first vegetable oil and the second vegetable oil are the same kind vegetable oil and the insulation liquid further contains a condensation polymer of polyamine fatty acid as described later, color reproducibility of a toner image to be formed becomes especially excellent.

Furthermore, in the case where the first vegetable oil is rape oil and the second vegetable oil is soy oil, the following effect can be obtained.

Namely, by using an insulation liquid containing rape oil and soy oil-alcohol ester-exchange liquid, it is possible to provide a liquid developer having especially excellent charge property. This is supposed to result from the reason that since both the rape oil and the soy oil-alcohol ester-exchange liquid have high electrical resistance, it is possible to exhibit charge property of the toner particles themselves sufficiently.

In general, rape oil contains as its main components an oleic acid component, a linolic acid component, and a linolenic acid component. In the present invention, it is preferable to use a rape oil containing an oleic acid component of 50 mol % or more, and it is more preferable to use a rape oil containing an oleic acid component of 60 to 80 mol %.

By using the rape oil containing such a relatively large amount of oleic acid component, it is possible to fix toner particles onto a recording medium firmly and it is also possible to make the environmental stability (storage stability) of the liquid developer sufficiently high.

The soy oil-alcohol ester-exchange liquid is constituted from a fatty acid monoester such as an oleic acid component, a linolic acid component, and a linolenic acid component, and the like.

In the case where the first vegetable oil is soy oil and the second vegetable oil is rape oil, the following effect can be obtained.

Namely, by using an insulation liquid containing soy oil and a rape oil-alcohol ester-exchange liquid, it is possible to provide a liquid developer by which a smooth toner image having no irregularities can be obtained so that the thus obtained image has especially excellent gloss.

This is supposed to result from the reason that since the rape oil-alcohol ester-exchange liquid is a component capable of exhibiting the plasticizing effect conspicuously, toner particles can easily enter into gaps of paper fibers of a recording medium.

In general, a rape oil-alcohol ester-exchange liquid contains as its main components an oleic acid component, a linolic acid component, and a linolenic acid component. In the present invention, it is preferable to use a rape oil-alcohol ester-exchange liquid containing an oleic acid component of 50 mol % or more, and it is more preferable to use a rape oil-alcohol ester-exchange liquid containing an oleic acid component of 60 to 80 mol %.

By using the rape oil-alcohol ester-exchange liquid containing such a relatively large amount of oleic acid component, it is possible to exhibit the plasticizing effect described above more conspicuously.

As a result, it is possible to fix toner particles against a recording medium more firmly, and it is also possible to make gloss of a toner image to be formed more excellent. Further, it is also possible to make the environmental stability (storage stability) of the liquid developer sufficiently high.

The soy oil contains as its main component a fatty acid component such as an oleic acid component, a linolic acid component, and a linolenic acid component, and the like.

Further, in the case where both the first vegetable oil and the second vegetable oil are soy oil and the liquid developer (insulation liquid) further contains a condensation polymer of polyamine fatty acid as a dispersant, the following effect can be obtained.

Namely, by using an insulation liquid containing soy oil and a soy oil-alcohol ester-exchange liquid, it is possible to provide a liquid developer by which a smooth toner image having no irregularities can be obtained so that the thus obtained image has especially excellent gloss.

This is supposed to result from the reason that since the soy oil-alcohol ester-exchange liquid is a component capable of exhibiting the plasticizing effect conspicuously, toner particles can easily enter into gaps of paper fibers of a recording medium.

Further, when the insulation liquid contains a condensation polymer of polyamine fatty acid in addition to the soy oil and the soy oil-alcohol ester-exchange liquid, it is possible to make the preservability of the liquid developer excellent as well as to make dispersion stability of the toner particles sufficiently high. This feature is supposed to result form the following reasons.

Since the condensation polymer of polyamine fatty acid has high affinity with a resin material constituting the toner particles, it is likely to adhere to the surfaces of the toner particles, and thus it is possible to prevent aggregation (blocking) of the toner particles effectively. Further, the condensation polymer of polyamine fatty acid also has high affinity with the soy oil (fatty acid triglyceride) and the soy oil-alcohol ester-exchange liquid (fatty acid monoester).

This makes it possible to make the dispersion stability of the toner particles sufficiently high. As a result, it is possible to make the preservability of the liquid developer excellent. Further, by using the insulation liquid described above together with the condensation polymer of polyamine fatty acid, the liquid developer can maintain its excellent dispersion stability for a long period of time.

Therefore, even in the case where images are repeatedly formed using the liquid developer, colors of the images are not so changed. That is, the liquid developer of the present invention can have good color reproducibility.

The condensation polymer of polyamine fatty acid is capable of making the impregnability of the fatty acid monoester contained in the soy oil-alcohol ester-exchange liquid into the toner particles sufficiently high, and thus the plasticizing effect of the soy oil-alcohol ester-exchange liquid can be exhibited more conspicuously.

As a result, it is possible to fix toner particles against a recording medium more firmly, and it is also possible to make gloss of a toner image to be formed more excellent.

Further, it is also possible to make the charge property of the toner particles sufficiently high.

Further, in the case where both the first vegetable oil and the second vegetable oil are rape oil and the liquid developer (insulation liquid) further contains a condensation polymer of polyamine fatty acid as a dispersant, the following effect can be obtained.

Namely, by using an insulation liquid containing rape oil and a rape oil-alcohol ester-exchange liquid obtained by an ester-exchange reaction of rape oil and a monovalent alcohol, it is possible to provide a liquid developer having especially excellent charge property.

This is supposed to result from the reason that since both the rape oil and the rape oil-alcohol ester-exchange liquid have high electrical resistance, it is possible to exhibit charge property of the toner particles themselves sufficiently.

In general, a rape oil-alcohol ester-exchange liquid contains as its main component an oleic acid component. In the present invention, it is preferable to use a rape oil-alcohol ester-exchange liquid containing an oleic acid component of 50 mol % or more, and it is more preferable to use a rape oil-alcohol ester-exchange liquid containing an oleic acid component of 60 to 80 mol %.

By using the rape oil-alcohol ester-exchange liquid containing such a relatively large amount of oleic acid component, it is possible to fix toner particles onto a recording medium firmly and it is also possible to make the environmental stability (storage stability) of the liquid developer sufficiently high.

Since the rape oil-alcohol ester-exchange liquid is easy to impregnate into the inside of the toner particle, it is possible to exhibit the plasticizing effect described above more conspicuously, and it is also possible to make the impregnability of the insulation liquid into the recording medium higher.

As a result, it is possible to fix toner particles against the recording medium more firmly, and it is also possible to make the charge property of the liquid developer more excellent since the rape oil-alcohol ester-exchange liquid has particularly high electric insulation.

Further, when the insulation liquid contains a condensation polymer of polyamine fatty acid in addition to the rape oil and the rape oil-alcohol ester-exchange liquid, it is possible to make the preservability of the liquid developer excellent as well as to make dispersion stability of the toner particles sufficiently high. This feature is supposed to result form the following reasons.

Since the condensation polymer of polyamine fatty acid has high affinity with a resin material constituting the toner particles, it is likely to adhere to the surfaces of the toner particles, and thus it is possible to prevent aggregation (blocking) of the toner particles effectively.

Further, the condensation polymer of polyamine fatty acid also has high affinity with the rape oil (fatty acid triglyceride) and the rape oil-alcohol ester-exchange liquid (fatty acid monoester). This makes it possible to make the dispersion stability of the toner particles sufficiently high. As a result, it is possible to make the preservability of the liquid developer excellent.

Further, it is also possible to make the charge property of the toner particles sufficiently high. Further, by using the insulation liquid described above together with the condensation polymer of polyamine fatty acid, the liquid developer can maintain its excellent dispersion stability for a long period of time.

Therefore, even in the case where images are repeatedly formed using the liquid developer, colors of the images are not so changed. That is, the liquid developer of the present invention can have good color reproducibility.

The condensation polymer of polyamine fatty acid is capable of making the impregnability of the fatty acid monoester contained rape oil-alcohol ester-exchange liquid into the toner particles sufficiently high, and thus the plasticizing effect by the rape oil-alcohol ester-exchange liquid can be exhibited more conspicuously.

This is supposed to result from the reason that the condensation polymer of polyamine fatty acid has high affinity with the fatty monoester contained in the rape oil-alcohol ester-exchange liquid, and thus the condensation polymer of polyamine fatty acid adhering to the surfaces of the toner particles can attract the fatty monoester on the surfaces of the toner particles.

When the amount of the vegetable oil contained in the insulation liquid is defined as X [wt %] and the amount of the vegetable oil-alcohol ester-exchange liquid contained in the insulation liquid is defined as Y [wt %], it is preferred that the relation of $0.1 \leqq X/Y \leqq 9$ is satisfied, more preferably the relation of $0.4 \leqq X/Y \leqq 9$ is satisfied, and even more preferably the relation of $0.6 \leqq X/Y \leqq 9$ is satisfied.

By satisfying such a relationship, the viscosity of the insulation liquid can be set more appropriately so that the liquid developer can be impregnated into the recording medium more suitably. As a result, the plasticizing effect described above can be exhibited conspicuously.

Further, the liquid developer (insulation liquid) of the present invention may further contain a dispersant for improving a dispersion stability of the toner particles.

Examples of such a dispersant include: polymer dispersants such as polyvinyl alcohol, carboxymethylcellulose, polyethylene glycol, Solsperse (trade name of LUBRIZOL JAPAN Ltd.), polycarboxylic acid, polycarboxylate, polyacrylic acid metal salts (e.g., sodium salts and the like), polymethacrylic acid metal salts (e.g., sodium salts and the like), polymaleic acid metal salts (e.g., sodium salts and the like), acrylic acid-maleic acid copolymer metal salts (e.g., sodium salts and the like), polystyrene sulfonate metal salts (e.g., sodium salts and the like), condensation polymer of polyamine fatty acid and the like; viscosity mineral, silica, tricalcium phosphate, tristearic acid metal salts (e.g., aluminum salts and the like), distearic acid metal salts (e.g., aluminum salts, barium salts and the like) r stearic acid metal salts (e.g., calcium salts, lead salts, zinc salts and the like), linolenic acid metal salts (e.g., cobalt salts, manganese salts, lead salts, zinc salts and the like), octanoic acid metal salts (e.g., aluminum salts, calcium salts, cobalt salts and the like), oleic acid metal salts (e.g., calcium salts, cobalt salts and the like), palmitic acid metal salts (e.g., zinc salts and the like), dodecylbenzenesulfonic acid metal salts (e.g., sodium salts and the like), naphthenic acid metal salts (e.g., calcium salts, cobalt salts, manganese salts, lead salts, zinc salts and the like), resin acid metal salts (e.g., calcium salts, cobalt salts, manganese salts, lead salts, zinc salts and the like).

Among described above dispersants, in the case where the condensation polymer of polyamine fatty acid is used, it can adhere to the surfaces of toner particles. This makes it possible to make the charge property of the toner particles higher.

Further, this makes it possible to prevent bonding or aggregation of the toner particles, thereby enabling the dispersion stability of the toner particles in the finally obtained liquid developer to be made sufficiently high.

In the case where the condensation polymer of polyamine fatty acid is used, an amount of the condensation polymer of polyamine fatty acid contained in the liquid developer is preferably in the range of 0.5 to 7.5 parts by weight with respect to 100 parts by weight of the toner particles, more preferably in the range of 1 to 5 parts by weight with respect to 100 parts by weight of the toner particles.

This makes it possible to make the above effect obtained using the condensation polymer of polyamine fatty acid more conspicuous.

Further, the liquid developer (insulation liquid) may further contain a charge control agent.

Examples of such a charge control agent include: metal oxides such as zinc oxide, aluminum oxide, magnesium oxide and the like; metal benzoates, metal salicylates, metal alkyl alicylates, catechol metal salts, bis azo dyes containing metal, nigrosin dyes, tetraphenyl borate derivatives, quaternary ammonium salts, alkylpyridinium salts, chlorinated polyesters, nitro phnic acid and the like.

When zinc oxide is contained in the liquid developer as the charge control agent, it is possible to raise a charge amount of the particles in an electrical field as compared to the case that no zinc oxide is contained in the liquid developer. As a result, the charge property of the liquid developer can be made higher.

An amount of zinc oxide contained in the liquid developer is preferably in the range of 0.5 to 4.0 parts by weight, more preferably in the range of 0.5 to 2.0 parts by weight, and even more preferably in the range of 1.25 to 2.0 parts by weight with respect to 100 parts by weight of the toner particles. This makes it possible to exhibit the effect described above more conspicuously.

When aluminum oxide is used as the charge control agent, it is possible to raise a charge amount of the particles in an electrical field as compared to the case that no aluminum oxide is contained in the liquid developer. As a result, the charge property of the liquid developer can be made higher.

An amount of aluminum oxide contained in the liquid developer is preferably in the range of 0.5 to 4.0 parts by weight, more preferably in the range of 0.5 to 2.0 parts by weight, and even more preferably in the range of 1.25 to 2.0 parts by weight with respect to 100 parts by weight of the toner particles. This makes it possible to exhibit the effect described above more conspicuously.

When magnesium oxide is used as the charge control agent, it is possible to raise a charge amount of the particles in an electrical field as compared to the case that no magnesium oxide is contained in the liquid developer. As a result, the charge property of the liquid developer can be made higher.

An amount of magnesium oxide contained in the liquid developer is preferably in the range of 0.5 to 4.0 parts by weight, more preferably in the range of 0.5 to 2.0 parts by weight, and even more preferably in the range of 1.25 to 2.0 parts by weight with respect to 100 parts by weight of the toner particles. This makes it possible to exhibit the effect described above more conspicuously.

An average particle size of the charge control agent described above is preferably in the range of 0.5 to 10 μm, more preferably in the range of 0.5 to 5 μm, and even more preferably in the range of 1 to 5 μm. This makes it possible to provide a liquid developer having the appropriate charge effect.

The electric resistance of the insulation liquid at room temperature (20° C.) described above is preferably equal to or higher than $1\times10^{12}$ Ωcm, and more preferably equal to or higher than $1\times10^{13}$ Ωcm.

Further, the dielectric constant of the insulation liquid is preferably equal to or lower than 3.5.

<Toner Particles>

Hereinbelow, a description will be made with regard to the toner particles.

Constituent Material of Toner Particles (Toner Material)

The toner particles (toner) contained in the liquid developer of the invention comprises at least a resin material.

<1> Resin Material (Binder Resin)

Toner particles contained in a liquid developer are constituted from a material which contains a resin material (resin) as its main component.

In the invention, there is no specific limitation on the kinds of the resin (binder resin) to be used. Examples of such a resin (binder resins) include styrene-based resins (homopolymers or copolymers containing styrene or styrene substituents) such as polystyrene, poly-α-methylstyrene, chloropolystyrene, styrene-chlorostyrene copolymer, styrene-propylene copolymer, styrene-butadiene copolymer, styrene-vinyl chloride copolymer, styrene-vinyl acetate copolymer, styrene-maleic acid copolymer, styrene-acrylic ester copolymer, styrene-methacrylic ester copolymer, styrene-acrylic ester-methacrylic ester copolymer, styrene-α-methyl chloroacrylate copolymer, styrene-acrylonitrile-acrylic ester copolymer, and styrene-vinyl methyl ether copolymer; polyester resin, epoxy resin, urethane-modified epoxy resin, silicone-modified epoxy resin, vinyl chloride resin, rosin-modified maleic acid resin, phenyl resin, polyethylene-based resin, polypropylene, ionomer resin, polyurethane resin, silicone resin, ketone resin, ethylene-ethylacrylate copolymer, xylene resin, polyvinyl butyral resin, terpene resin, phenol resin, and aliphatic or alicyclic hydrocarbon resin. These binder resins can be used singly or in combination of two or more of them.

Among these resins, polyester resin is preferably used, since polyester resin has good affinity with an insulation liquid containing vegetable oil and a vegetable oil-alcohol ester-exchange liquid. Therefore, by using the polyester resin, it is possible to make fixing property of the toner particles to a recording medium particularly excellent while making the dispersion stability of the toner particles in the insulation liquid especially excellent.

Further, since the polyester resin has high transparency, in the case where the polyester resin is used as the binder resin, color development of an obtained image becomes excellent.

The softening point of the resin (resin material) is not particularly limited to any specific value, but it is preferably in the range of 50 to 130° C., more preferably in the range of 50 to 120° C., and even more preferably in the range of 60 to 115° C.

In this specification, the term "softening point" means a temperature at which softening is begun under the conditions that a temperature raising speed is 5° C./min and a diameter of a die hole is 1.0 mm in a high-floored flow tester (manufactured by Shimadzu Corporation).

<2> Coloring Agent

The toner particles of the liquid developer also contains a coloring agent. As for a coloring agent, pigments, dyes or the like can be used.

Examples of such pigments and dyes include Carbon Black, Spirit Black, Lamp Black (C.I. No. 77266), Magnetite, Titanium Black, Chrome Yellow, Cadmium Yellow, Mineral Fast Yellow, Navel Yellow, Naphthol Yellow S, Hansa Yellow G, Permanent Yellow NCG, chrome Yellow, Benzidine Yellow, Quinoline Yellow, Tartrazine Lake, Chrome Orange, Molybdenum Orange, Permanent Orange GTR, Pyrazolone Orange, Benzidine Orange G, Cadmium Red, Permanent Red 4R, Watching Red Calcium Salts, Eosine Lake, Brilliant Carmine 3B, Manganese Violet, Fast Violet B, Methyl Violet Lake, Prussian Blue, Cobalt Blue, Alkali Blue Lake, Victoria Blue Lake, Fast Sky Blue, Indanthrene Blue BC, Ultramarine Blue, Aniline Blue, Phthalocyanine Blue, Chalco Oil Blue, Chrome Green, Chromium Oxide, Pigment Green B, Malachite Green Lake, Phthalocyanine Green, Final Yellow Green G, Rhodamine 6G, Quinacridone, Rose Bengal (C.I. No. 45432), C.I. Direct Red 1, C.I. Direct Red 4, C.I. Acid Red 1, C.I. Basic Red 1, C.I. Mordant Red 30, C.I. Pigment Red 48:1, C.I. Pigment Red 57:1, C.I. Pigment Red 122, C.I. Pigment Red 184, C.I. Direct Blue 1, C.I. Direct Blue 2, C.I. Acid Blue 9, C.I. Acid Blue 15, C.I. Basic Blue 3, C.I. Basic Blue 5, C.I. Mordant Blue 7, C.I. Pigment Blue 15:1, C.I. Pigment Blue 15:3, C.I. Pigment Blue 5:1, C.I. Direct Green 6, C.I. Basic Green 4, C.I. Basic Green 6, C.I. Pigment Yellow 17, C.I. Pigment Yellow 93, C.I. Pigment Yellow 97, C.I. Pigment Yellow 12, C.I. Pigment Yellow 180, C.I. Pigment Yellow 162, and Nigrosine Dye (C.I. No. 50415B); metal oxides such as metal complex dyes, silica, aluminum oxide, magnetite, maghemite, various kinds of ferrites, cupric oxide, nickel oxide, zinc oxide, zirconium oxide, titanium oxide, magnesium oxide, and the like; and magnetic materials including magnetic metals such as Fe, Co, and Ni; and the like. These pigments and dyes can be used singly or in combination of two or more of them.

<3> Other Components

In the toner particles, additional components other than the above components may be contained. Examples of such other components include wax, magnetic powder, and the like.

Examples of a wax include hydrocarbon wax such as ozokerite, ceresin, paraffin wax, micro wax, microcrystalline wax, petrolatum, Fischer-Tropsch wax, or the like; ester wax such as carnauba wax, rice wax, methyl laurate, methyl myristate, methyl palmitate, methyl stearate, butyl stearate, candelilla wax, cotton wax, Japan wax, beeswax, lanolin, montan wax, fatty acid ester, or the like; olefin wax such as polyethylene wax, polypropylene wax, oxidized polyethylene wax, oxidized polypropylene wax, or the like; amide wax such as 12-hydroxystearic acid amide, stearic acid amide, phthalic anhydride imide, or the like; ketone wax such as laurone, stearone, or the like; ether wax; and the like. These waxes can be used singly or in combination of two or more.

Further, examples of a magnetic powder include a powder made of a magnetic material containing a metal oxide such as magnetite, maghemite, various kinds of ferrites, cupric oxide, nickel oxide, zinc oxide, zirconium oxide, titanium oxide, magnesium oxide, or the like, and/or magnetic metal such as Fe, Co or Ni.

Further, the toner particles (constituent material of the toner particles) may further contain zinc stearate, zinc oxide, cerium oxide, silica, titanium oxide, iron oxide, aliphatic acid, or aliphatic metal salt, or the like in addition to the components described above.

Shape of Toner Particles

In the liquid developer of the present invention, it is preferred that each toner particle is formed with very fine irregularities on the surface thereof. By forming such irregularities on the surface of the particle, it is possible to unevenly distribute (adsorb) the fatty acid monoester on the surface of each particle.

The average particle size (diameter) of the toner particles constituted from the above described materials is preferably in the range of 0.1 to 5 μm, more preferably in the range of 0.1 to 4 μm, and even more preferably in the range of 0.5 to 3 μm.

If the average particle size of the toner particles is within the above range, it is possible to make resolution of a toner image formed from the liquid developer (liquid toner) sufficiently high.

Furthermore, in the toner particles contained in the liquid developer, an average roundness R represented by the following formula (I) is preferably in the range of 0.94 to 0.99, and more preferably in the range of 0.96 to 0.99.

$$R=L_0/L_1 \quad \text{(I)}$$

wherein $L_1$ (μm) represents the circumference of a projected image of a toner particle that is a subject of measurement, and $L_0$ (μm) represents the circumference of a perfect circle (a geometrically perfect circle) having the same area as that of the projected image of the toner particle that is a subject of measurement.

When the average roundness R of the toner particles is within the above range, an appropriate amount of insulation liquid can be contained in an unfixed image transferred onto a recording medium so that a fixing strength of the toner particles can be made higher.

Further, the amount of the toner particles contained in the liquid developer is preferably in the range of 10 to 60 wt %, and more preferably in the range of 25 to 50 wt %.

It is preferred that the viscosity (measured according to JIS Z8809 using a vibration type viscometer at a temperature of 25° C.) of the liquid developer (the liquid developer of the present invention) constituted from the components as described above is in the range of 50 to 1,000 mPa·s, more preferably in the range of 100 to 900 mPa·s, and even more preferably in the range of 150 to 800 mPa·s.

The liquid developer having the viscosity within the above ranges is easily impregnated into a recording medium. Therefore, fixing property of the toner particles to a recording medium becomes excellent, and a clear and uneven color image can be formed on the recording medium, and thus such a liquid developer can be suitably used for high speed image formation.

However, in the case where the vegetable oil-alcohol ester-exchange liquid is not contained in the insulation liquid, the viscosity of the insulation liquid becomes too high, and in such a case toner particles are fixed onto a recording medium with a state that a large amount of insulation liquid adheres to the surfaces of the toner particles.

When such a large amount of insulation liquid is present on the surfaces of the toner particles, since the insulation liquid having high viscosity is difficult to be impregnated into a recording medium, there is a case that fixing property of the toner particles becomes worse and thus image formation at high speed becomes difficult.

Further, in the case where the fatty acid triglyceride is not contained in the insulation liquid, the viscosity of the insulation liquid becomes too low. When a liquid developer having such low viscosity is used in the image forming apparatus as described below, it is difficult to dip the liquid developer from the developer container by the application roller.

As a result, there is a case that it becomes difficult to fix toner particles onto a recording medium uniformly, which results in an uneven color image and an image having a low image density, and further fixing property of toner particles onto a recording medium becomes insufficient.

Further, the electric resistance of the liquid developer constituted from the components as described above, that is, the liquid developer of the present invention is preferably $1\times10^{12}$ Ωcm or higher, and more preferably $3\times10^{12}$ Ωcm or higher.

<<Method of Producing Liquid Developer>>

Hereinbelow, a preferred embodiment of a method of producing a liquid developer of the present invention will be described.

The liquid developer producing method of this embodiment includes an associated particle formation step of associating resin fine particles mainly constituted from a resin material to obtain associated particles, a step of obtaining a toner particle dispersion liquid comprised of a vegetable oil-alcohol ester-exchange liquid and toner particles dispersed in the liquid which is obtained by disassociating the associated particles in the vegetable oil-alcohol ester-exchange liquid, and a mixing step of mixing the thus obtained toner particles dispersion liquid and a vegetable oil.

Production of Associated Particles

Hereinbelow, a description will be made with regard to one example of a method of producing associated particles which are formed by associating resin fine particles mainly constituted from a resin material.

The associated particles may be formed by various methods. In this embodiment, a water-based dispersion liquid comprised of a water-based dispersion medium constituted from a water-based liquid and a dispersoid (fine particles) constituted from a resin material (toner material) dispersed in the water-based dispersion medium is first obtained, and then the dispersoid in the water-based dispersion medium is associated to thereby obtain the associated particles.

Preparation of Water-Based Dispersion Liquid

Hereinbelow, a description will be made with regard to preparation of the water-based dispersion liquid.

The water-based dispersion liquid may be prepared by various methods. In this embodiment, the toner material as described above is first dissolved in a solvent to thereby obtain a toner material solution, the toner material solution is then mixed with a water-based dispersion medium constituted from a water-based liquid to thereby obtain a water-based emulsion in which the dispersoid (liquid state dispersoid) containing the toner material is dispersed, and then at least a part of the solvent contained in the water-based emulsion is removed to thereby obtain the water-based dispersion liquid.

For example, the water-based emulsion may be prepared as follows (water-based Emulsion Preparation Step).

First, a water-based dispersion medium is prepared.

In the present invention, the water-based dispersion medium is constituted from a water-based liquid. In the present invention, the term "water-based liquid" means a liquid constituted from water and/or a liquid having good compatibility with water (for example, a liquid having a solubility of 30 g or higher with respect to water of 100 g at 25° C.).

As described above, the water-based liquid is constituted from water and/or a liquid having good compatibility with water, but it is preferred that the water-based liquid is mainly constituted from water. Preferably, the water content is 70 wt % or more, and more preferably the water content is 90 wt % or more.

By using such a water-based liquid, it is possible to increase the dispersion stability of the dispersoid in the water-based dispersion medium and thus it is also possible to make the dispersoid in the water-based emulsion have small particle size and small particle size variation.

As a result, the toner particles in the finally obtained insulation liquid can have small particle size variation and large roundness.

Examples of such the water-based liquid include water, alcohol-based solvents such as methanol, ethanol, propanol, and the like; ether-based solvents such as 1,4-dioxane, tetrahydrofuran (THF), and the like; aromatic heterocyclic compound-based solvents such as pyridine, pyrazine, pyrrole, and the like; amide-based solvents such as N,N-dimethylformamide (DMF), N,N-dimethylacetamide (DMA), and the like; nitrile-based solvents such as acetonitrile, and the like; and aldehyde-based solvents such as acetaldehyde, and the like.

Further, in preparing the water-based emulsion, an emulsion dispersant or the like may be used for the purpose of improving the dispersion stability of the water-based dispersion medium. This makes it possible to prepare the water-based emulsion more easily Examples of such emulsion dispersant include: inorganic dispersants such as viscosity mineral, silica, tricalcium phosphate, and the like; nonionic organic dispersants such as polyvinyl alcohol, carboxymethyl cellulose, polyethylene glycol, hydroxy stearic acid ester and the like; anionic organic dispersants such as tristearic acid metal salts (e.g., aluminum salts), distearic acid metal salts (e.g., aluminum salts and barium salts), stearic acid metal salts (e.g., calcium salts, lead salts, and zinc salts), linolenic acid metal salts (e.g., cobalt salts, manganese salts, lead salts, and zinc salts), octanoic acid metal salts (e.g., aluminum salts, calcium salts, and cobalt salts), oleic acid metal salts (e.g., calcium salts and cobalt salts), palmitic acid metal salts (e.g., zinc salts), dodecylbenzenesulfonic acid metal salts (e.g., sodium salts), naphthenic acid metal salts (e.g., calcium salts, cobalt salts, manganese salts, lead salts, and zinc salts), resin acid metal salts (e.g., calcium salts, cobalt salts, manganese salts, lead salts, and zinc salts), polyacrylic acid metal salts (e.g., sodium salts), polymethacrylic acid metal salts (e.g., sodium salts), polymaleic acid metal salts (e.g., sodium salts), metal salts of acrylic acid-maleic acid copolymer (e.g., sodium salts), polystyrenesulfonic acid metal salts (e.g., sodium salts); and cationic organic dispersants such as quaternary ammonium salts, and the like.

The toner material solution is prepared by dissolving the toner material as described above into a solvent.

Various solvents may be employed if they can dissolve a part of the toner material, but it is preferable to use a solvent having a boiling point lower than that of the water-based liquid. This makes it possible to remove the solvent easily.

Further, it is also preferred that the solvent has low compatibility with the water-based dispersion medium (water-based liquid) (for example, a liquid having a solubility of 30 g or lower with respect to water-based liquid of 100 g at 25° C.). This makes it possible for the toner material to be finely dispersed in the water-based emulsion in a stable manner.

Further, a composition of the solvent can be selected appropriately according to the compositions of the resin and the coloring agent to be used, and the compositions of the water-based dispersion medium to be used or the like.

Either of an inorganic solvent or an organic solvent can be used as the solvent.

Examples of such an inorganic solvent include carbon disulfide, carbon tetrachloride and the like. Examples of such an organic solvent include; ketone solvents such as methyl ethyl ketone (MEK), acetone, diethyl ketone, methyl isobutyl ketone (MIBK), methyl isopropyl ketone (MIPK), cyclohexanone, 3-heptanone, 4-heptanone and the like; alcohols solvent such as methanol, ethanol, n-propanol, iso-propanol, n-butanol, iso-butanol, tert-butanol, 3-methyl-1-butanol, 1-pentanol, 2-pentanol, n-hexanol, cyclohexanol, 1-heptanol, 1-octanol, 2-octanol, 2-methoxy ethanol, allyl alcohol, furfuryl alcohol, phenol and the like; ether solvents such as diethyl ether, dipropyl ether, diisopropyl ether, dibutyl ether, 1,2-dimethoxy ethane (DME), 1,4-dioxane, tetrahydrofuran (THF), tetrahydropyran (THP), anisole, diethyleneglycol dimethyl ether (diglim), 2-methoxy ethanol and the like; cellosolve solvents such as methyl cellosolve, ethyl cellosolve, phenyl cellosolve and the like; aliphatic hydrocarbon solvents such as hexane, pentane, heptane, cyclo hexane, methyl cyclo hexane, octane, didecane, methyl cyclo hexane, isoprene and the like; aromatic hydrocarbon solvents such as toluene, xylene, benzene, ethyl benzene, naphthalene and the like; aromatic heterocyclic compound solvents such as pyridine, pyridine, furan, pyrrole, thiophene, 2-methyl pyridine, 3-methyl pyridine, 4-methyl pyridine, furfuryl alcohol and the like; amide solvents such as N,N-dimethylformamide (DMF), N,N-dimethylacetamide (DMA) and the like; halogen compound solvents such as dichloromethane, chloroform, 1,2-dichloroetane, trichloroethylene, chlorobenzene and the like; ester solvents such as acetylacetone, ethyl acetate, methyl acetate, isopropyl acetate, isobutyl acetate, isopentyl acetate, ethyl chloroacetate, isobutyl chloroacetate, ethyl formate, isobutyl formate, ethyl acrylate, methyl methacrylate, ethyl benzoate and the like; amine solvents such as trimethylamine, hexylamine, triethylamine, aniline and the like; nitrile solvents such as acrylonitrile, acetonitrile and the like; nitro solvents such as nitromethane, nitroethane and the like; aldehyde solvents such as acetaldehyde, propionaldehyde, pentylaldehyde, acrylaldehyde and the like. These solvents can be used singly or in combination of two or more of them.

In preparing the toner material solution, a kneaded material obtained by kneading the toner material such as the resin material, the coloring agent and the like may be used.

By using such a kneaded material as described above, even in the case where the constituent material of the liquid developer contains components which are difficult to be dispersed or dissolved to each other, it is possible to obtain a state that the components are mutually dissolved and finely dispersed in a satisfactory level in the kneaded material obtained by the kneading process.

In particular, in the case where a pigment (coloring agent) having relatively low dispersion stability to a solvent as described above is used, a periphery of each particle of the pigment is effectively coated with the resin component of the kneaded material during the kneading process carried out before the dispersion to the solvent.

This makes it possible to improve dispersion stability of the pigment to the solvent (particularly, it becomes possible to finely disperse the particles of the pigment in the solvent). As a result, the finally obtained liquid developer can exhibit excellent color development.

Accordingly, even in the case where the constituent material of the toner particles contains a component having poor dispersion stability to the water-based dispersion medium of the water-based emulsion and/or a component having poor solubility to the solvent contained in the water-based dispersion medium of the water-based emulsion, it is possible to make the dispersion stability of the dispersoid contained in the water-based emulsion especially excellent.

Next, the toner material solution is added drop by drop to the water-based dispersion medium with being stirred. As a result, it is possible to obtain the water-based emulsion comprised of the water-based dispersion medium and the dispersoid containing the toner material which is dispersed in the water-based dispersion medium. In this regard, it is to be noted that when the toner material solution is added drop by drop, the water-based dispersion medium and/or the toner material solution may be heated.

Thereafter, by heating the thus obtained water-based emulsion or placing it under reduced pressure, at least a part of the solvent contained in the water-based emulsion is removed. As a result, it is possible to obtain the water-based dispersion liquid in which the dispersoid (fine particles) constituted of the toner material is dispersed.

An amount of the dispersoid in the water-based dispersion liquid is not particularly limited, but preferably in the range of 5 to 55 wt %, and more preferably in the range of 10 to 50 wt %. This makes it possible to prevent bonding or aggregation of particles of the dispersoid in the water-based dispersion liquid more reliably, thereby enabling productivity of the toner particles (liquid developer) to be particularly excellent.

An average diameter of the particles of the dispersoid in the water-based dispersion liquid is not particularly limited, but preferably in the range of 0.01 to 3 μm, and more preferably in the range of 0.1 to 2 μm. This makes it possible to make the size of the toner particles finally obtained optimum. In this regard, it is to be noted that the term "average diameter" means an average diameter of particles each having a reference volume.

Associated Particle Formation Step

Next, an electrolyte is added to the water-based dispersion liquid obtained by the processes as described above so that the fine particles of the dispersoid are associated to thereby form associated particles.

Examples of an electrolyte to be added include: acidic substances such as hydrochloric acid, sulfuric acid, phosphoric acid, acetic acid, oxalic acid and the like; organic or inorganic soluble salts such as sodium sulfate, ammonium sulfate, potassium sulfate, magnesium sulfate, sodium phosphate, sodium dihydrogen phosphate, sodium chloride, potassium chloride, ammonium chloride, calcium chloride, sodium acetate and the like. These electrolytes can be used singly or in combination of two or more.

Among these electrolytes, sulfate salts of monovalent cation such as potassium sulfate, ammonium sulfate and the like are preferably used because association of the fine particles is carried out uniformly.

Further, before the electrolyte is added to the water-based dispersion liquid, an inorganic dispersion stabilizer such as hydroxyapatite; ionic surfactant, nonionic surfactant and the like may be added to the water-based dispersion liquid. By adding the electrolyte to the water-based dispersion liquid under the existence of the dispersion stabilizer (emulsifier), it is possible to prevent ununiform association.

Examples of such a dispersion stabilizer include: nonionic surfactants such as polyoxyethylene nonyl phenyl ether, polyoxyethylene octyl phenyl ether, polyoxyethylene dodecyl phenyl ether, polyoxyethylene alkyl ether, polyoxyethylene fatty acid ester, sorbitan fatty acid ester, polyoxyethylene sorbitan fatty acid ester, various pluronic types and the like; anionic surfactants such as alkyl sulfate ester salt types; cationic surfactants such as quaternary ammonium salt types; and the like.

Among these dispersion stabilizers, anionic surfactants and nonionic surfactants are preferably used because of being capable of exhibiting the excellent dispersion stability with the addition of a small amount thereof. A cloud point of the nonionic surfactants is preferably equal to or higher than 40° C.

An amount of the electrolyte to be added is preferably in the range of 0.5 to 15 parts by weight by weight, more preferably in the range of 1 to 12 parts by weight, even more preferably in the range of 1 to 10 parts by weight with respect to 100 parts by weight of solid components of the water-based dispersion liquid.

If the amount of the electrolyte is lower than the lower limit value, there is a case that association of the dispersoid does not progress sufficiently.

Further, if the amount of the electrolyte exceeds the higher limit value, association of the dispersoid becomes ununiform. As a result, there is a possibility that coarsened particles are produced in the water-based dispersion liquid, and thereby the size of toner particles finally obtained becomes uneven.

Next, after associating the fine particles of the dispersoid, associated particles are obtained by filtering, washing, and drying them.

An average particle size of the obtained associated particles is preferably in the range of 0.1 to 7 μm, and more preferably in the range of 0.5 to 3 μm. This enables toner particles finally obtained to have an appropriate particle size.

Disassociating Step (Step of Obtaining Toner Particle Dispersion)

Next, the associated particles are disassociated in a vegetable oil-alcohol ester-exchange liquid to thereby obtain a toner particle dispersion liquid comprised of the toner particles dispersed in the vegetable oil-alcohol ester-exchange liquid.

Further, by disassociating the associated particles in the vegetable oil-alcohol ester-exchange liquid in this way, the fatty acid monoester contained in the vegetable oil-alcohol ester-exchange liquid can adhere (exist) on the surfaces of toner particles in the liquid developer finally obtained.

By allowing the fatty acid monoester to adhere or exist on the surfaces of the toner particles in this way, the above-described plasticizing effect becomes more conspicuous. As a result, since the toner particles can easily enter into gaps of paper fibers (recording medium), it is possible to make fixing strength of the toner particles more excellent.

Further, since the associated particles are disassociated in the vegetable oil-alcohol ester-exchange liquid, it is possible to prevent production of toner particles coarsened by the aggregation and the like.

Further, since the obtained toner particles have gaps derived from the fine particles (dispersoid) on the surfaces thereof, the fatty acid monoester is retained in the gaps reliably.

Further, in this embodiment, since the toner particles are obtained by disassociating the associated particles, it is possible to prevent generation of fine powder (extremely fine particles which are smaller than the particles having a target particle size.) as compared to the case where the conventional disassociating method or wet crushing method is used. As a result, it is possible to effectively prevent deterioration of the charge property of the liquid developer due to the presence of the fine powder.

Further, since the vegetable oil-alcohol ester-exchange liquid has relatively lower viscosity, the vegetable oil-alcohol ester-exchange liquid can easily enter into spaces among the fine particles constituting each of the associated particles, and thus it is possible to disassociate the associated particles relatively easily.

Mixing Step

Next, the thus obtained toner particle dispersion liquid is mixed with the vegetable oil, so that an insulation liquid in which the toner particles are dispersed is obtained.

Through the processes as described above, it is possible to obtain a liquid developer of the present invention which is comprised of an insulation liquid and toner particles dispersed in the insulation liquid, wherein the insulation liquid contains a vegetable oil and a reaction product produced by an ester exchange reaction of a vegetable oil and a monovalent alcohol.

<<Image Forming Apparatus>>

Next, a description will be made with regard to preferred embodiments of an image forming apparatus to which the liquid developer of the invention can be used.

First Embodiment

First, a description will be made with regard to the first embodiment of the image forming apparatus to which the liquid developer of the invention can be used.

FIG. 1 is an illustration which shows one example of a contact type image forming apparatus to which the liquid developer of the present invention can be used.

The image forming apparatus P1 includes a developer container (liquid developer storage section) P11, a cylindrical photoreceptor (developing section) P2 for developing an image (toner image), a developing unit P10 for supplying the liquid developer from the developer container P11 to the photoreceptor P2, an intermediate transfer roller (transfer section) P18 for transferring an image developed on the photoreceptor P2 onto a recording medium, and a fixing unit (fixing section) F40 which will be described in details.

The surface of the photoreceptor P2 is coated with a material such as amorphous silicon or the like. Amorphous silicon has extremely high rigidity as compared to the conventional photoreceptor having a surface formed of an organic material, and thus the photoreceptor P2 has superior abrasion resistant property. Therefore, according to the photoreceptor P2, it is possible to prevent the surface of the photoreceptor P2 from being damaged by the contact with toner particles appropriately.

Further, it is also possible to prevent the components of the photoreceptor P2 from being deteriorated by the insulation liquid of the liquid developer. The photoreceptor P2 having these features has a long duration of life and thus is suitable for use for long period of time.

Further, the photoreceptor P2 has superior stability of electrical properties for repeated use and also has excellent resistant to environment (such as temperature and moisture of use environment), and thus it is possible to maintain developing accuracy to a recording medium at a high level for a long period of time.

After the surface of the photoreceptor P2 is uniformly charged with a charging device P3, exposure P4 corresponding to information to be recorded is carried out using a laser diode or the like so that an electrostatic latent image is formed. The developing unit P10 has an application roller P12 a part of which is immersed in a developer container P11 and a development roller P13.

The application roller P12 is formed, for example, a gravure roller made of stainless steel, brass or the like, which rotates with opposing to the development roller P13.

On the surface of the application roller P12, a liquid developer application layer P14 is formed, and the thickness of the layer is adapted to be kept constant by a metering blade P15. Further, a liquid developer is transferred from the application roller P12 to the development roller P13.

The development roller P13 is constructed from a metallic roller core member P16 made from stainless steel or the like, a low hardness silicone rubber layer provided on the metallic core member P16, and a fluorocarbon resin layer made of a conductive PFA (polytetrafluoroetylene-perfluorovinylether copolymer) or the like formed on the silicone rubber layer.

The development roller P13 is adapted to rotate at the same speed as the photoreceptor P2 to transfer the liquid developer to a latent image section.

A part of the liquid developer remaining on the development roller P13 after it has been transferred to the photoreceptor P2 is removed by a development roller cleaning blade P17 and then collected in the developer container P11.

In this regard, it is to be noted that the photoreceptor P2, the developing unit P10, and other related elements constitute a developing section for developing a toner image using the liquid developer supplied from the liquid developer storage section.

Further, after a image (toner image) is transferred from the photoreceptor P2 to an intermediate transfer roller P18, the photoreceptor P2 is discharged with discharging light P21, and a toner which has not been transferred and remains on the photoreceptor P2 is removed by a cleaning blade P22 made of a urethane rubber or the like.

In a similar manner, a toner which is not transferred and remains on the intermediate transfer roller P18 after the toner image has been transferred to the recording medium F5 is removed by a cleaning blade P23 made of a urethane rubber or the like.

The image (toner image) formed on the photoreceptor P2 is transferred to the intermediate transfer roller P18. Then, a transfer current is supplied to a secondary transfer roller P19, and the toner image transferred on the intermediate roller P18 is transferred onto the recording medium F5 such as a paper or the like which passes between the intermediate transfer rollers P18 and the secondary transfer roller P19.

Namely, the intermediate transfer roller P18, the secondary transfer roller P19, and other related elements constitute an transfer section for transferring the image formed on the developing section onto a recording medium to form a transferred image thereon.

Thereafter, the toner image transferred on the recording medium F5 such as a paper or the like is fixed thereto using the fixing unit F40 which will be described later.

Figure 2:
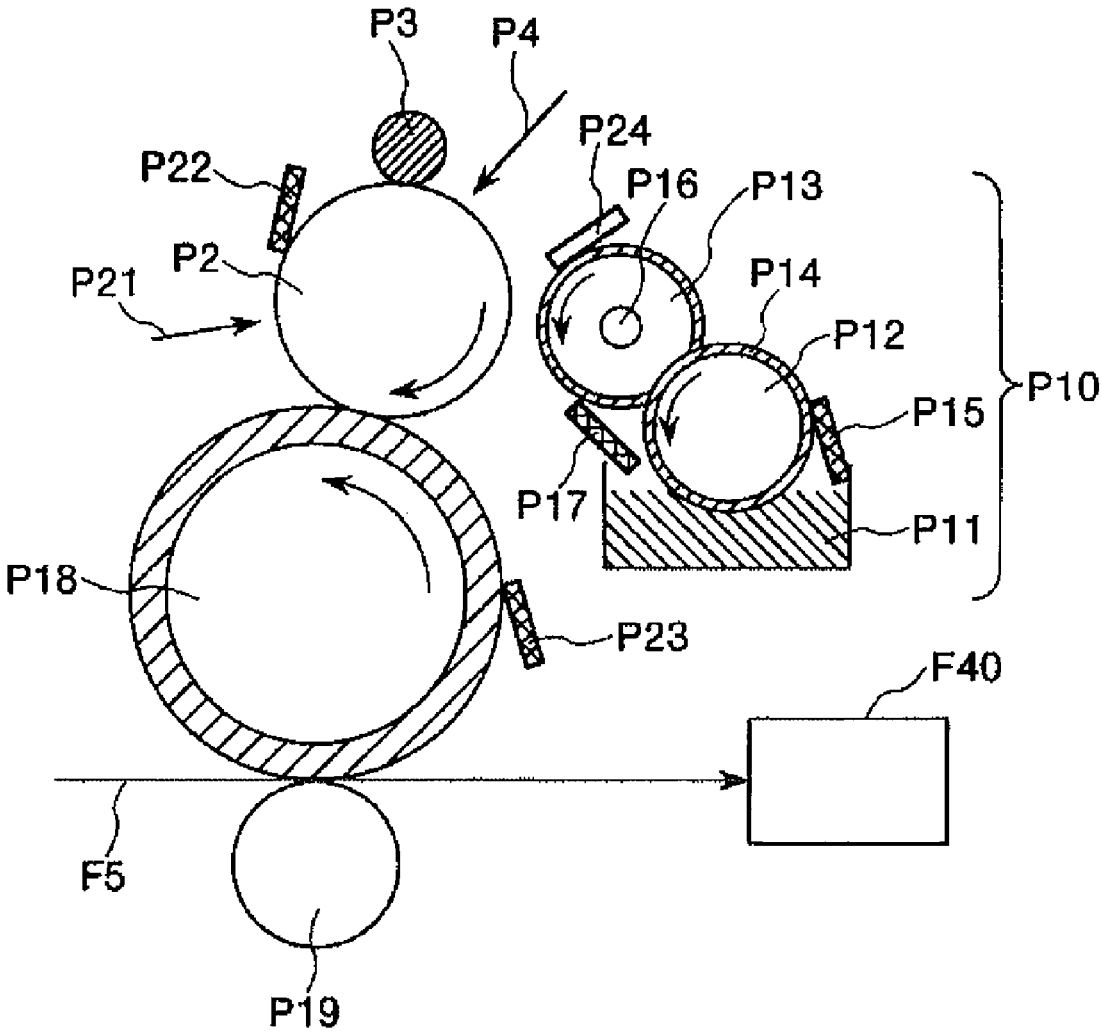
FIG. 2 is an illustration which shows one example of a contact type image forming apparatus to which the liquid developer of the present invention can be used.

FIG. 2 is a cross sectional view which shows one example of a non-contact type liquid developing unit provided in an image forming apparatus according to the invention. In such a non-contact type liquid developing unit, a development roller P13 is provided with a charging blade 24 which is formed from a phosphor-bronze plate.

The charging blade 24 has a function of causing a layer of the liquid developer to be charged by contacting it. Further, since an application roller P12 is a gravure roller, a layer of a developer having irregularities which correspond to irregularities on the surface of the gravure roller is formed on the development roller P13.

The charging blade 24 also has a function of uniforming the irregularities formed on the development roller P13. The orientation of the charging blade 24 is either of a counter direction or a trail direction with respect to the rotational direction of the development roller. Further, the charging blade 24 may be in the form of a roller not a blade.

Preferably, between the development roller P13 and the photoreceptor P2, there is formed a gap whose width is 200 μm to 800 μm, and an AC voltage having 500 to 3000 Vpp and a frequency of 50 to 3000 Hz which is superimposed on a DC voltage of 200 to 800 V is applied across the development roller P13 and the photoreceptor P2. Other structures of this non-contact type liquid developing unit are the same as those of the contact type liquid developing unit shown in FIG. 1.

In the foregoing, the description was made with regard to the image formation by the embodiments shown in FIGS. 1 and 2 in which a liquid developer of one color is used. However, it goes without saying that when an image is formed using color toners of a plurality of colors, a color image can be formed by using a plurality of liquid developer storage sections and developing sections corresponding to the respective colors to form images of the respective colors.

Figure 3:
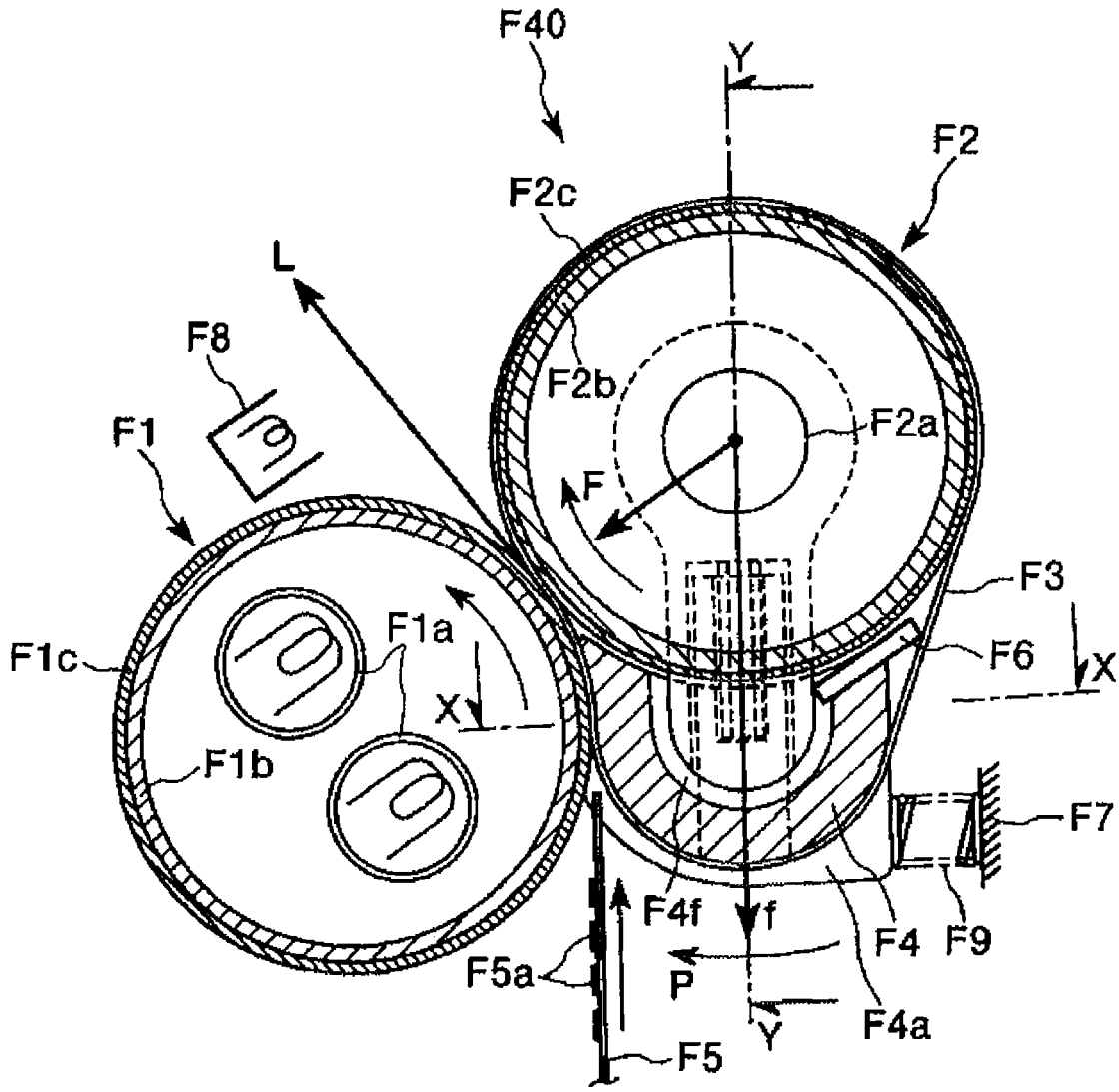
FIG. 3 is a cross-sectional view which shows one example of a fixing unit provided in an image forming apparatus according to the invention.

FIG. 3 is a cross-sectional view which shows one example of a fixing unit provided in an image forming apparatus according to the invention.

The fixing unit (fixing section) F40 is provided for fixing unfixed toner images F5*a* formed on the developing section P2 and the transfer section 18 onto a recording medium F5.

As shown in the FIG. 3, the fixing unit (fixing section) F40 is generally composed from a heat fixing roller F1, a pressure roller F2, a heat resistant belt F3, a belt tension member F4, a cleaning member F6, a frame F7, an ultraviolet emitting means F8 and a spring F9.

The heat fixing roller (hereinafter, simply referred to as "fixing roller") F1 has a roller base F1*b* formed from a pipe member, an elastic body F1*c* which covers the outer periphery of the roller base F1*b*, and a pair of halogen lamps F1*a* provided inside the roller base F1. Each of the halogen lamps F1*a* has a columnar shape and acts as a heat source. The heat fixing roller F1 having the above structure is rotatable in an anti-clockwise direction shown by the arrow in the drawing.

Further, the pressure roller F2 has a roller base F2*b* formed from a pipe member and an elastic body F2*c* which covers the outer periphery of the roller base F2*b*. The pressure roller F2 is rotatable in a clockwise direction shown by the arrow in the drawing.

On the outer surface of the elastic body F1*c* of the heat fixing roller F1, there is formed a PFA layer. By composing the heat fixing roller F1 and the pressure roller F2 as mentioned above, even if the thickness of the elastic body F1*c* of the heat fixing roller F1 is different from the thickness of the elastic body F2*c* of the pressure roller F2, the elastic body F1*c* and the elastic body F2*c* are subjected to substantially uniform elastic deformation to form a so-called horizontal nip.

Further, since there is no difference between a circumferential velocity of the heat fixing roller F1 and a conveying speed of a heat resistant belt F3 described below or a recording medium F5, it is possible to fix an image in an extremely stable manner.

Further, as described above, inside the heat fixing roller F1, two halogen lamps F1*a*, F1*a* each having a columnar shape and acting as a heat source are provided. These halogen lamps F1*a*, F1*a* are provided with heating elements, respectively, which are arranged at different positions.

With this arrangement, by selectively lighting up any one or both of the halogen lamps F1*a*, F1*a*, it is possible to easily carry out a temperature control under different conditions such as a case where a wide recording medium is used or a narrow recording medium is used, and/or a case where a fixing nip part at which the heat resistant belt F3 is wound around the heat fixing roller F1 is to be heated or a part at which the belt tension member F4 is in slidably contact with the heat fixing roller F1 is to be heated.

The pressure roller F2 is arranged so as to face the heat fixing roller F1 so that a pressing pressure is applied against the recording medium F5 on which an unfixed toner image is formed through a heat resistant belt F3. By applying the pressing pressure against the recording medium F5 on which the unfixed toner image, the insulation liquid is impregnated into the recording medium F5 effectively.

By heating the unfixed toner image and emitting ultraviolet rays or the like to the unfixed toner image as mentioned below, the unsaturated fatty acid component contained in the insulation liquid can be cured more reliably inside the recording medium F5. As a result, the above anchoring effect is exhibited to thereby fix a toner image F5*a* on the recording medium F5 more firmly.

Further, as described above, the pressure roller F2 has a roller base F2*b* formed from a pipe member and an elastic body F2*c* which covers the outer periphery of the roller base F2*b*. The pressure roller F2 is rotatable in a clockwise direction shown by the arrow in the drawing.

The elastic body F1*c* of the heat fixing roller F1 and the elastic body F2*c* of the pressure roller F2 are subjected to substantially uniform elastic deformation to form a so-called horizontal nip. Further, since there is no difference between a circumferential velocity of the heat fixing roller F1 and a conveying speed of a heat resistant belt F3 described below or a recording medium F5, it is possible to fix an image in an extremely stable manner.

The heat resistant belt F3 is a ring-shaped endless belt, and it is would around the outer circumferences of the pressure roller F2 and the belt tension member P4 so that it can be moved with being held between the heat fixing roller F1 and the pressure roller F2 in a pressed state.

The heat resistant belt F3 is formed from a seamless tube having a thickness of 0.03 mm or more. Further, the seamless tube has a two layered structure in which its surface (which is the surface thereof that makes contact with the recording medium F5) is formed of PFA, and the opposite surface thereof (that is, the surface thereof that makes contact with the pressure roller F2 and the belt tension member F4) is formed of polyimide.

However, the structure of the heat resistant belt F3 is not limited to the structure described above, and it may be formed from other materials. Examples of tubes formed from other materials include a metallic tube such as a stainless tube or a nickel electrocasting tube, a heat-resistance resin tube such as a silicone tube, and the like.

The belt tension member F4 is disposed on the upstream side of the fixing nip part between the heat fixing roller F1 and the pressure roller F2 in the recording medium F5 conveying direction. Further, the belt tension member F4 is pivotally disposed about the rotation shaft F2*a* of the pressure roller F2 so as to be movable along the arrow P.

The belt tension member F4 is constructed so that the heat resistant belt F3 is extended with tension in the tangential direction of the heat fixing roller F1 in a state that the recording medium F5 does not pass through the fixing nip part. When the fixing pressure is large at an initial position where the recording medium F5 enters the fixing nip part, there is a case that the recording medium F5 can not enter the fixing nip part smoothly and thereby fixation is performed in a state that a tip part of the recording medium F5 is folded.

However, in this embodiment, the belt tension member F4 is provided so that the heat resistant belt F3 is extended with tension in the tangential direction of the heat fixing roller F1 as described above, there is formed an introducing portion for smoothly introducing the recording medium F5, so that the recording medium F5 can be introduced into the fixing nip part in a stable manner.

The belt tension member F4 is a roughly semi-circular member for slidably guiding the heat resistant belt F3 (that is, the heat resistant belt F3 slidably moves on the belt tension member F4). The belt tension member F4 is fitted into the inside of the heat resistant belt F3 so as to impart tension f to the heat resistant belt F3 in cooperation with the pressure roller F2.

The belt tension member F4 is arranged at a position where a nip part is formed by pressing a part of the heat resistant belt F3 toward the heat fixing roller F1 over the tangential line L on the pressing portion at which the heat fixing roller F1 is pressed against the pressure roller F2.

The protruding wall F4*a* is formed on any one or both of the end surfaces of the belt tension member F4 which are located in the axial direction thereof. The protruding wall F4*a* is provided for restricting the heat resistant belt F3 from being off to the side by abutment thereto in a case that the heat resistant belt F3 is deviated in any one of the sides.

Further, a spring F9 is provided between the frame and an end portion of the protruding wall F4*a* which is located at an opposite side from the heat fixing roller F1 so as to slightly press the protruding wall F4*a* of the belt tension member F4 against the heat fixing roller F1. In this way, the belt tension member F4 is positioned with respect to the heat fixing roller F1 in slidably contact with the heat fixing roller F1.

A position where the belt tension member F4 is slightly pressed against the heat fixing roller F1 is set as a nip starting position and a position where the pressure roller F2 is pressed against the heat fixing roller F1 is set as a nip ending position.

In the fixing unit F40, a recording medium F5 on which an unfixed toner image F5*a* is formed using the above liquid developing unit enters into the fixing nip part from the nip starting position, then passes between the heat resistant belt F3 and the heat fixing roller F1, and then exits from the nip ending position, and in this way an unfixed toner image F5*a* formed on the recording medium F5 is fixed.

Thereafter, the recording medium 2 on which the toner image is formed is fed out toward the tangential direction L of the pressing potion of the press roller F2 against the heat fixing roller F1.

The ultraviolet emitting means F8 has a function that emits ultraviolet rays to a surface of the recording medium F5 fed out as described above, the surface on which the toner image F5*a* is formed.

With the structure of the fixing unit described above, unsaturated fatty acid components contained in the insulation liquid can be firmly cured with the application of heat and the irradiation of ultraviolet rays, and as a result, it is possible to fix the toner particles onto a recording medium more firmly.

Further, owing to the irradiation of ultraviolet rays, the toner particles can be fixed onto a recording medium firmly without heating the heat fixing roller F1 to an especially high temperature. Therefore, it is possible to provide a synergistic effect with the effects obtained by using the liquid developer of the present invention. That is, it is possible to fix the toner particles onto a recording medium at a relatively low temperature and at a high speed as well to fix the toner particles onto the recording medium more firmly.

Further, since a large amount of heat is not required for the fixing process, it is possible to fix the toner particles onto a recording medium reliably with the irradiation of ultraviolet rays even if a time required for the recording medium to pass through the fixing nip part is set to be relatively short.

This means that since it does not take so long time for the fixing process, it is possible to speed up a printing speed further. Further, a large amount of heat is not required for the fixing process, it is possible to save energy. As a result, it is possible to provide a fixing unit which is better for the environment.

The cleaning member F6 is disposed between the pressure roller F2 and the belt tension member F4. The cleaning member F6 is provided for cleaning foreign substances or wear debris on the inner surface of the heat resistant belt F3 by slidably contacting with the inner surface of the heat resistant belt F3.

By cleaning the foreign substances and wear debris in this way, it is possible to refresh the heat resistant belt F3 to eliminate the unstable factors on the frictional coefficients described above: Further, the belt tension member F4 is formed with a concave portion F4*f*, and this concave portion F4*f* is preferably used for collecting the foreign substances or wear debris eliminated from the heat resistant belt F3.

In order to stably drive the heat resistant belt F3 by the pressure roller F2 in a state that the heat resistant belt F3 is wound around the pressure roller F2 and the belt tension member F4, the frictional coefficient between the pressure roll F2 and the heat resistant belt F3 is set to be larger than the frictional coefficient between the belt tension member F4 and the heat resistant belt F3.

However, there is a case that these frictional coefficients become unstable due to entering of foreign substances between the heat resistant belt F3 and the pressure roller P2 or between the heat resistant belt F3 and the belt tension member F4, or due to the abrasion of the contacting part between the heat resistant belt F3 and the pressure roller F2 or the belt tension member F4.

Accordingly, the winding angle of the heat resistant belt F3 with respect to the belt tension member F4 is set to be smaller than the winding angle of the heat resistant belt F3 with respect to the pressure roller F2, and the diameter of the belt tension member F4 is set to be smaller than the diameter of the pressure roller F2.

With this structure, the distance that the heat resistant belt P3 moves on the belt tension member F4 becomes short so that unstable factors due to deterioration with the elapse of time and disturbance can be avoided or reduced. As a result, it is possible to drive the heat resistant belt F3 with the pressure roller F2 in a stable manner.

The time required for the toner particles to pass through the fixing nip part (that is, nip time) is preferably in the range of 0.02 to 0.2 seconds, and more preferably in the range of 0.03 to 0.1 seconds. Even if the time required for the toner particles to pass through the fixing nip part is set to the above short range, by using the liquid developer of the invention the toner particles are fixed against the recording medium F5 sufficiently. This makes it possible to print an image at higher speed.

A fixing temperature which is applied to the toner images by the heat fixing roller F1 is preferably in the range of 80 to 200° C., and more preferably in the range of 100 to 180° C. when the fixing temperature is within the above range, the oxidation polymerization reaction (curing reaction) of the unsaturated fatty acid compositions contained in the insulation liquid can progress effectively.

Second Embodiment

Next, a description will be made with regard to a second embodiment of the image forming apparatus to which the liquid developer of the invention can be used.

In this regard, it is to be noted that the second embodiment is directed to an image forming apparatus which forms a color image onto a recording medium using the liquid developer of the present invention as described above.

Figure 4:
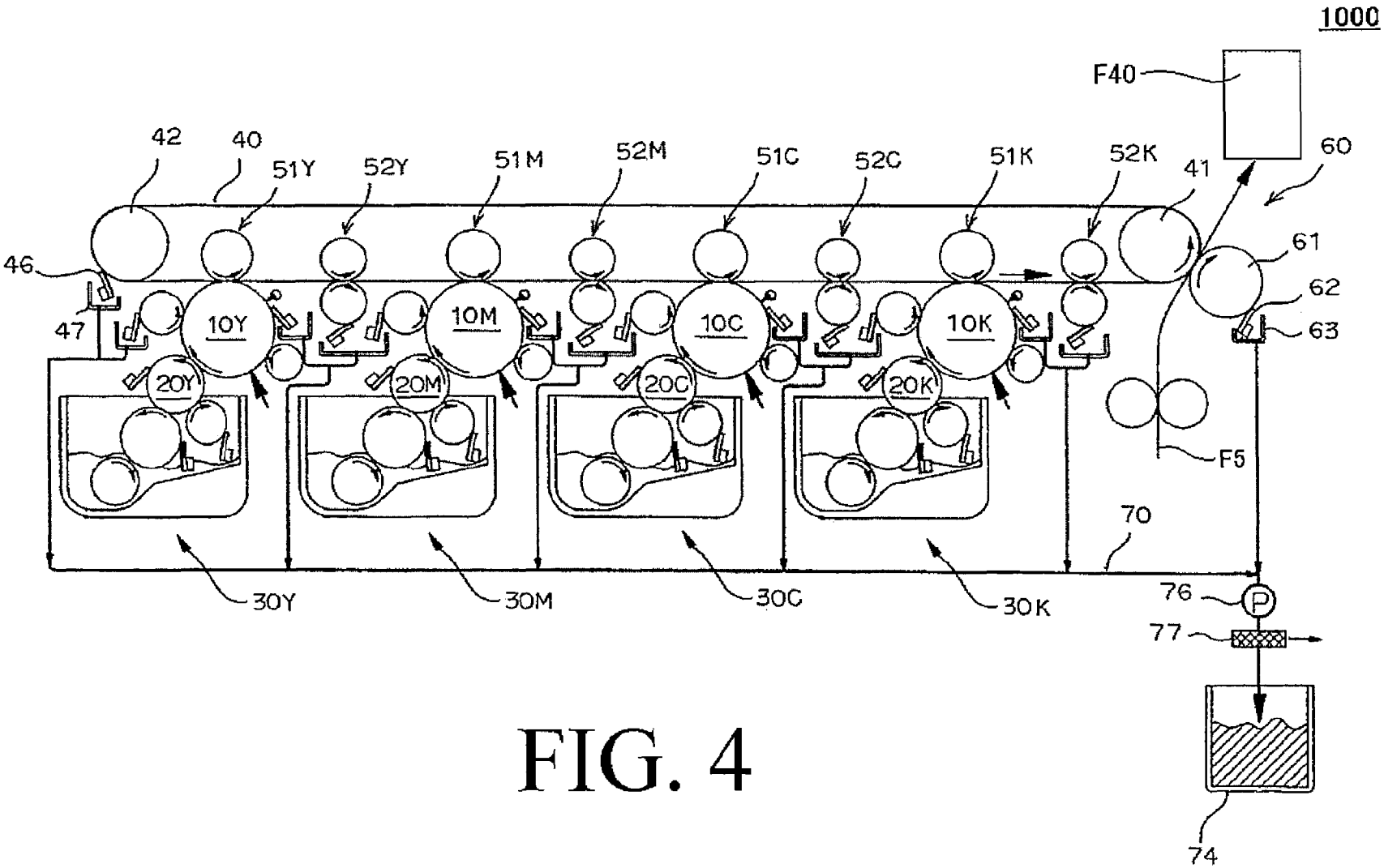
FIG. 4 is a schematic view which shows one example of a second embodiment of the image forming apparatus to which the liquid developer of the present invention can be used.
Figure 5:
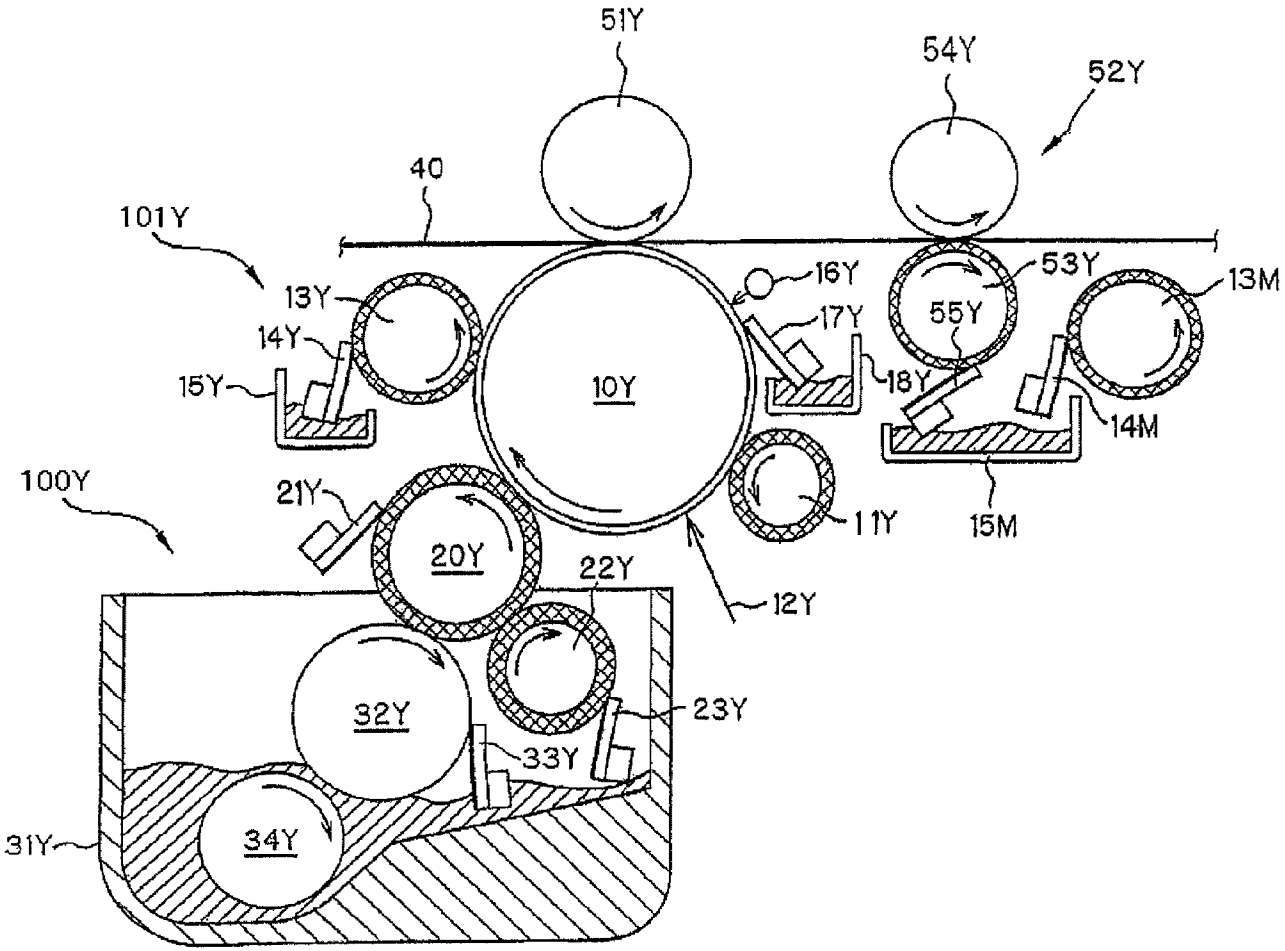
FIG. 5 is an enlarged view of a part of the image forming apparatus shown in FIG. 4.
Figure 6:
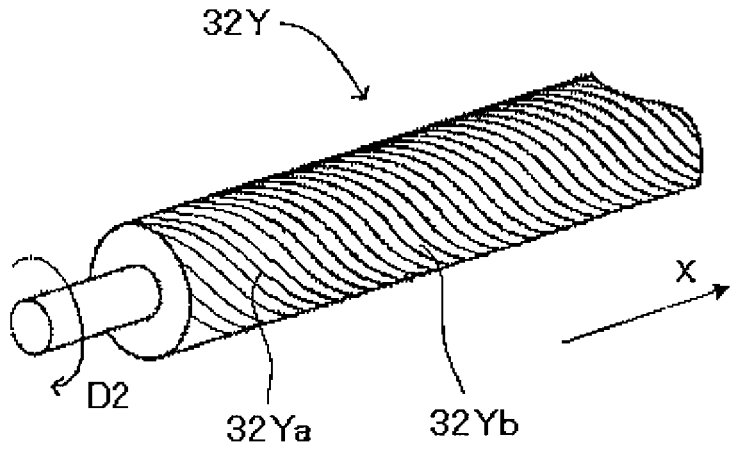
FIG. 6 is a schematic perspective view which shows an application roller provided in the image forming apparatus shown in FIG. 4.
Figure 7:
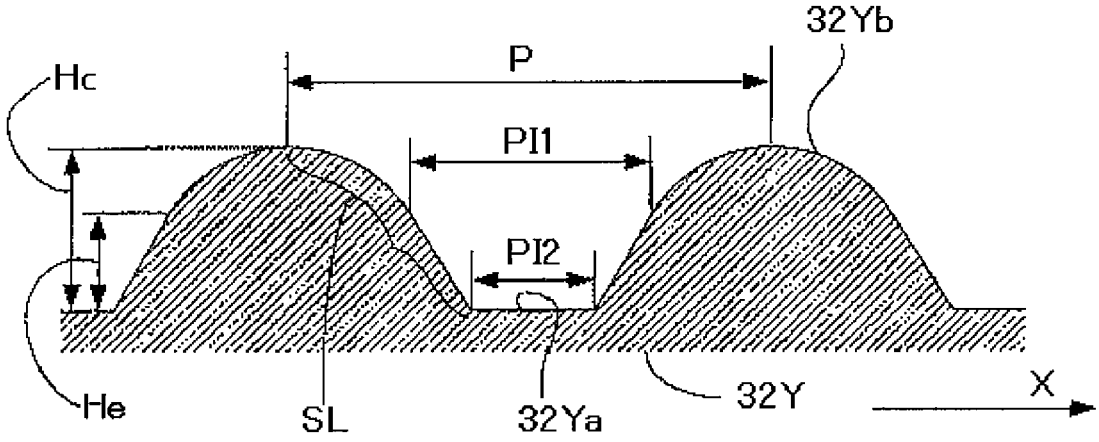
FIG. 7 is an enlarged schematic view of the application roller shown in FIG. 6.
Figure 8:
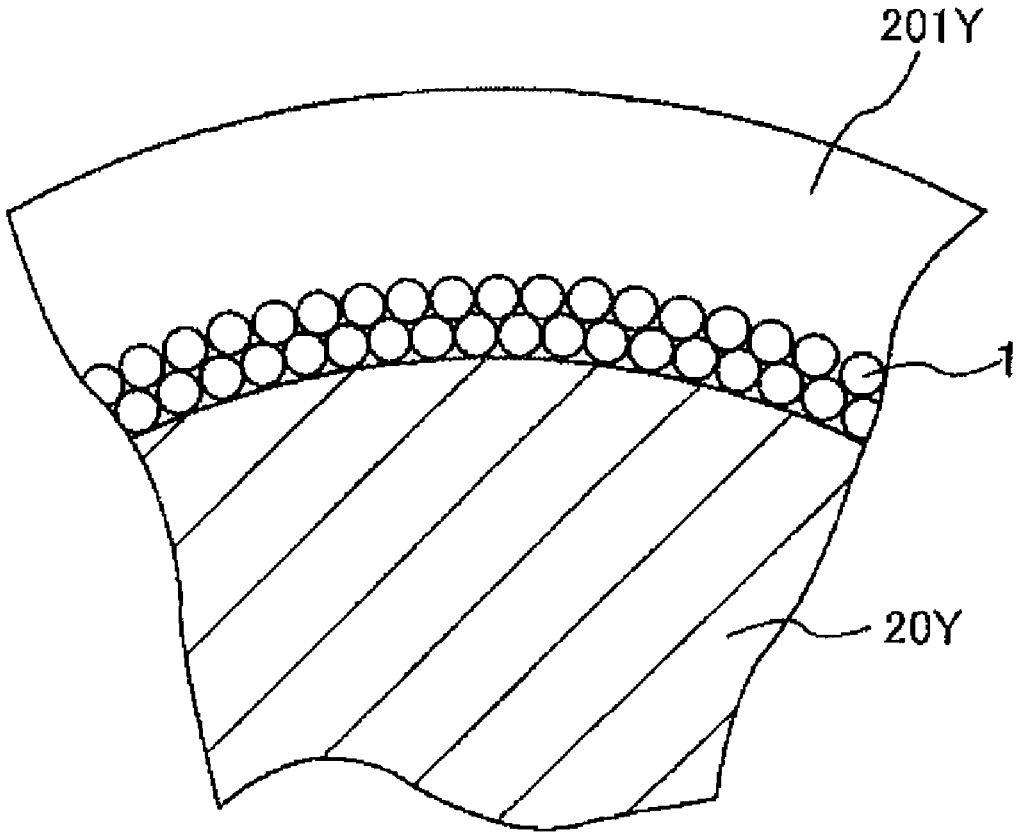
FIG. 8 is a schematic view which shows a state of toner particles in a layer of the liquid developer on the development roller.

FIG. 4 is a schematic view which shows one example of a second embodiment of the image forming apparatus to which the liquid developer of the present invention can be used, FIG. 5 is an enlarged view of a part of the image forming apparatus shown in FIG. 4, FIG. 6 is a schematic perspective view which shows an application roller provided in the image forming apparatus shown in FIG. 4, FIG. 7 is an enlarged schematic view of the application roller shown in FIG. 6, and FIG. 8 is a schematic view which shows a state of toner particles in a layer of the liquid developer on the development roller.

As shown in FIG. 4, the image forming apparatus 1000 includes four developing sections comprised of 30Y, 30C, 30M and 30K, an intermediate transfer section 40, a secondary transfer unit (secondary transfer section) 60 and a fixing section (fixing unit) F40 used in the first embodiment of the image forming apparatus.

The developing sections 30Y, 30C and 30M contain respectively a yellow (Y) liquid developer, a cyan (C) liquid developer, and a magenta (M) liquid developer, and have the functions of developing latent images with the liquid developers to form monochromatic color images corresponding to the respective colors. Further, the developing section 30K contains a black (K) liquid developer, and has the function of developing a latent image with the liquid developer to form a black monochromatic image.

The developing sections 30Y, 30C, 30M and 30K have the same structure. Therefore, in the following, the developing section 30Y will be representatively described.

As shown in FIG. 5, the developing section 30Y includes a photoreceptor 10Y which carries a latent image and rotates in the direction of the arrow shown in the drawings. The image forming apparatus 1000 further includes an electrifying roller 11Y, an exposure unit 12Y, a developing unit 100Y, a photoreceptor squeeze device 101Y, a primary transfer backup roller 51Y, an electricity removal unit 16Y, a photoreceptor cleaning blade 17Y, and a developer collecting section 18Y, and they are arranged in the named order along the rotational direction of the photoreceptor 10Y.

The photoreceptor 10Y includes a cylindrical conductive base member and a photosensitive layer (both not shown in the drawings) formed on the outer peripheral surface of the base member, and is rotatable about the axis thereof in the clockwise direction as shown by the arrow in FIG. 4.

The surface of the photoreceptor 10Y is coated with a material such as amorphous silicon or the like. Amorphous silicon has extremely high rigidity as compared to the conventional photoreceptor having a surface formed of an organic material, and thus the photoreceptor 10Y has superior abrasion resistant property. Therefore, according to the photoreceptor 10Y, it is possible to prevent the surface of the photoreceptor 10Y from being damaged by the contact with toner particles appropriately.

Further, it is also possible to prevent the components of the photoreceptor 10Y from being deteriorated by the insulation liquid of the liquid developer. The photoreceptor 10Y having these features has a long duration of life and thus is suitable for use for long period of time.

Further, the photoreceptor 10Y has superior stability of electrical properties for repeated use and also has excellent resistant to the environment (such as temperature and moisture of use environment), and thus it is possible to maintain developing accuracy to a recording medium at a high level for a long period of time.

The liquid developer from the developing unit 100Y is supplied onto the surface of the photoreceptor 10Y so that a layer of the liquid developer is formed on the surface.

The electrifying roller 11Y is a device for uniformly electrifying the surface of the photoreceptor 10Y. The exposure unit 12Y is a device that forms an electrostatic latent image on the uniformly photoreceptor 10Y by means of laser beam irradiation.

The exposure unit 12Y includes a semiconductor laser, a polygon mirror, or an F-θ lens, or the like, and irradiates a modulated laser beam onto the electrified photoreceptor 10Y in accordance with image signals received from a host computer such as a personal computer, a word processor or the like not shown in the drawings.

The developing unit 100Y is a device which develops the latent image to be visible with the liquid developer of the invention. The details of the developing unit 100Y will be described later.

The photoreceptor squeeze device 101Y is disposed so as to face the photoreceptor 10Y at the downstream side of the developing unit 100Y in the rotational direction thereof. The photoreceptor squeeze device 101Y is composed from a photoreceptor squeeze roller 13Y, a cleaning blade 14Y which is press contact with the photoreceptor squeeze roller 13Y for removing a liquid developer adhering to the surface of the photoreceptor squeeze roller 13Y, and a developer collecting section 15Y for collecting the removed liquid developer.

The photoreceptor squeeze device 101Y has a function of collecting of an excess carrier (insulation liquid) and a fog toner which is inherently unnecessary from the liquid developer developed by the photoreceptor 10Y to increase a ratio of the toner particles in the image to be formed.

The primary transfer backup roller 51Y is a device for transferring a monochrome toner image formed on the photoreceptor 10Y to the intermediate transfer section (belt) 40.

The electricity removal unit 16Y is a device for removing a remnant charge on the photoreceptor 10Y after an intermediate image has been transferred to the intermediate transfer section 40 by the primary transfer backup roller 51Y.

The photoreceptor cleaning blade 17Y is a member made of rubber and provided in contact with the surface of the photoreceptor 10Y, and has a function of scrapping off the liquid developer remaining on the photoreceptor 10Y after the image has been transferred onto the intermediate transfer section 40 by the primary transfer backup roller 51Y.

The developer collecting section 18Y is provided for collecting the liquid developer removed by the photoreceptor cleaning blade 17Y.

The intermediate transfer section 40 is composed from an endless elastic belt which is wound around a belt drive roller 41 and a tension roller 42, and the endless belt is rotationally driven by the belt drive roller 41 in contact with the photoreceptors 10Y, 10M, 10C and 10K at respective positions of the primary transfer backup rollers 51Y, 51C, 51M and 51.

Monochromatic images corresponding to the respective colors formed by the developing sections 30Y, 30C, 30M and 30K are sequentially transferred by the primary transfer backup roller 51Y, 51C, 51M and 51K so that the monochromatic images corresponding to the respective colors are overlaid, thereby enabling a full color toner image (intermediate transferred image) to be formed on the intermediate transfer section 40 which will be described later.

The intermediate transfer section 40 carries the monochromatic images formed on the respective photoreceptors 10Y, 10M, 10C and 10K in a state that these images are successively secondary-transferred onto the belt so as to be overlaid one after another, and the overlaid images are transferred onto a recoding medium F5 such as paper, film and cloth as a single color image.

In the meantime, when the toner image is transferred onto the recording medium F5 in the secondary transfer process, there is a case that the recording medium F5 is not a flat sheet material due to fibers thereof. The elastic belt is employed as a means for increasing a secondary transfer characteristic for such a non-flat sheet material.

At the side of the tension roller 42 which constitutes the intermediate transfer section 40 together with the belt drive roller 41, a cleaning device composed from an intermediate transfer section cleaning blade 46 and a developer collecting section 47.

The intermediate transfer section cleaning blade 46 has a function of scrapping off of the liquid developer adhering to the intermediate transfer section 40 to remove it after the image has been transferred onto a recording medium by the secondary transfer roller 61.

The developer collecting section 47 is provided for collecting the liquid developer removed by the intermediate transfer section cleaning blade 46.

An intermediate transfer second squeeze device 52Y is provided at the downstream side of the primary transfer backup roller 51Y in the moving direction of the intermediate transfer section 40.

The intermediate transfer squeeze device 52Y is provided as a means for removing an excess amount of the insulation liquid from the transferred liquid developer in the case where the liquid developer transferred onto the intermediate transfer section 40 does not have a desired dispersion state.

The intermediate transfer squeeze device 52Y includes an intermediate transfer squeeze roller 53Y, an intermediate transfer squeeze backup roller 54Y which is arranged so as to be opposed to the intermediate transfer squeeze roller 53Y through the intermediate transfer section 40, an intermediate transfer squeeze roller cleaning blade 55Y which is in press contact with the intermediate transfer squeeze roller 53Y for cleaning the surface thereof, and a liquid developer collecting section 15M.

The intermediate transfer squeeze device 52Y has a function of collecting an excess carrier from the liquid developer primary-transferred to the intermediate transfer section 40 to increase a ratio of the toner particles in an image to be formed and collecting a fog toner which is inherently unnecessary.

The developer collecting section 15M is also used for collecting a carrier which is collected by a cleaning blade 14M for a magenta photoreceptor squeeze roller which is arranged at the downstream side of the intermediate transfer section 40 in the moving direction thereof.

By commonly using each of the developer collecting sections 15 (M, C, K) as each of the developer collecting sections for the intermediate transfer section squeeze devices 52 (Y, M, C), respectively, it is possible to set the interval between the adjacent developer collecting sections in the same distance, thereby enabling the structure of the image forming apparatus to be simplified and small-sized.

In the secondary transfer unit 60, the secondary transfer roller 61 is arranged so as to be opposed to the belt drive roller 41 through the intermediate transfer section 40. Further, the secondary transfer unit 60 includes a cleaning device composed from a cleaning blade 62 for the secondary transfer roller 61 and a developer collecting section 63.

In the secondary transfer unit 60, at a timing that an intermediate image formed on the intermediate transfer section 40 by overlaying difference color images reaches at the image transfer position of the secondary transfer unit 60, a recording medium F5 is conveyed and supplied, so that the intermediate image is secondary-transferred onto the recording medium F5.

A toner image (transferred image) F5*a* transferred onto the recording medium F5 by the secondary transfer section 60 is fed to a fixing unit (fixing device) F40 (which will be described later), where the unfixed toner image is fixed onto the recoding medium F5.

The cleaning blade 62 has a function of scrapping off the liquid developer adhering to the second transfer roller 61 to remove it after the image has been transferred onto the recording medium F5 by the second transfer roller 61.

The developer collecting section 63 is provided for collecting the liquid developer removed by the cleaning blade 62.

Hereinbelow, a detailed description will be made with regard to the developing units 100Y, 100C, 100M and 100K. In this regard, it is to be noted that since the developing units 100Y, 100C, 100M and 100K have the same structure, in the following description the developing section 100Y will be representatively described.

As shown in FIG. 5, the developing unit 100Y includes a liquid developer storage section 31Y, an application roller 32Y, a regulating blade 33Y, a liquid developer stirring roller 34Y, a developing roller 20Y, a developing roller cleaning blade 21Y and a developer pressing roller (pressing means) 22Y.

The liquid developer storage section 31Y is provided for storing a liquid developer for developing a latent image formed on the photoreceptor 10Y. The application roller 32Y has the function of supplying the liquid developer to the developing roller 20Y.

As shown in FIG. 6, the application roller 32Y is of the type so-called as "Anilox Roller" which is constructed from a metallic roll made of iron or the like of which surface has grooves 32Y*a* formed regularly and helically, and a nickel plating formed on the surface.

The diameter of the roller is about 25 mm. As shown in FIG. 6, in this embodiment, a number of grooves 32Y*a* are formed inclinedly with respect to the rotational direction D2 by means of a cutting process or rolling process.

The application roller 32Y rotates in a clockwise direction and makes contact with the liquid developer so that the liquid developer stored in the liquid developer storage section 31Y is carried by the grooves 32Y*a*, and the carried liquid developer is then conveyed to the developing roller 20Y. Therefore, the application roller 32Y is capable of applying the liquid developer onto the developing roller 20Y with a portion of the roller where the grooves 32Y*a* are formed in the X direction of the roller.

In this regard, it is to be noted that the pitch of the grooves (that is, a periodical interval between the tips of the adjacent threads forming the grooves 32Y*a* in the X direction of FIG. 7) is preferably set to 55 to 250 μm depending on the necessary thickness of the layer of the liquid developer.

In this embodiment, the groove pitch P is set to be about 80 μm, the width of each thread is set to be about 40 μm, the width between the upper portions of the adjacent threads P11 is set to be about 50 μm, the width between the lower portions of the adjacent threads P12 is set to be about 30 μm, the depth He of each groove 32Y*a* is set to be about 20 μm, and the height of each thread 32Y*b* is set to be about 30 μm, so that a gently slanting part SL which extends from the tip of each thread to the bottom of each groove 32Y*a* is formed.

Further, in this embodiment, the surface roughness Rz (R1*a*) of the thread portions 32Y*b* is set to be nearly equal to 1.0 μm and the surface roughness Rz (R2*a*) of the groove portions 32Y*a* is also set to be nearly equal to 1.0 μm.

In the case where the conventional liquid developer is applied to the image formation apparatus provided with the application roller having the grooves as described above, there is a problem in that uneven color image described above is likely to appear conspicuously in an image formed. However, as described above, by using the liquid developer of the present invention, it is possible to prevent or suppress the generation the uneven color image.

The regulating blade 33Y is provided in contact with the surface of the application roller 32Y for regulating an amount of the liquid developer D carried on the application roller 32Y. Specifically, the regulating blade 33Y scrapes away an excess amount of the liquid developer D on the application roller 32Y so that an amount of the liquid developer D to be supplied onto the developing roller 20Y by the application roller 32Y can be regulated.

The regulating blade 33Y is formed from an elastic body made of an urethane rubber, and supported by a regulating blade supporting member made of a metal such as iron or the like. Further, the regulating blade 33Y is arranged on the side where the application roller 32Y comes out of the liquid developer D with its rotation (that is, on the left side of the vertical plane A in FIG. 5).

In this regard, it is to be noted that the rubber hardness of the regulating blade 33Y, that is, a rubber hardness (77) of a portion of the regulating blade 33Y which in press contact with the surface of the application roller 32Y is about 77 according to JIS-A.

The rubber hardness (77) of the regulating blade 33Y is lower than the rubber hardness of an elastic layer of the developing roller 20Y (described later) which is a rubber hardness (about 85) of a portion of the developing roller 20Y which is in press contact with the surface of the application roller 32Y.

The liquid developer stirring roller 34Y has a function of stirring the liquid developer so as to be homogeneously deispersed.

In the liquid developer storage section 31Y, toner particles of the liquid developer are positively charged. The liquid developer is stirred by the liquid developer stirring roller 34Y to be a homogeneously dispersed state, and such liquid developer is dipped from the liquid developer storage section 31Y according to the rotation of the application roller 32Y so that the liquid developer is supplied onto the developing roller 20Y with the amount of the liquid developer being regulated by the regulating blade 33Y.

The developing roller 20Y is provided for conveying the liquid developer to a developing position opposed to the photoreceptor 10Y in order to develop a latent image carried on the photoreceptor 10Y with the liquid developer.

The liquid developer from the application roller 32Y is supplied onto the surface of the developing roller 20Y so that a layer of the liquid developer 201Y is formed on the surface.

The developing roller 20Y includes an inner core member made of a metal such as iron or the like and an elastic layer having conductivity and provided onto an outer periphery of the inner core member. The diameter of the developing roller 20Y is about 20 mm.

The elastic layer has a two layered structure which includes an inner layer made of urethane rubber and an outer layer (surface layer) made of urethane rubber. The inner layer has a rubber hardness of 30 according to JIS-A and a thickness of about 5 mm, and the outer layer has a rubber hardness of about 85 according to JIS-A and a thickness of about 30 μm.

The developing roller 20Y is in press contact with both the application roller 32Y and the photoreceptor 10Y in a state that the outer layer of the developing roller 20Y is elastically deformed.

The developing roller 20Y is rotatable about its central axis, and the central axis is positioned below the central axis of the photoreceptor 10Y. Further, the developing roller 20Y rotates in a direction (clockwise direction in FIG. 5) opposite to the rotational direction (anti-clockwise direction in FIG. 5) of the photoreceptor 10Y.

It is to be noted that an electrical field is generated between the developing roller 20Y and the photoreceptor 10Y when a latent image formed on the photoreceptor 10Y is developed.

The developer pressing roller 22Y is a device having a function of pressing toner particles of the liquid developer carried by the developing roller 20Y. In other words, the developer pressing roller 22Y is a device that applies an electrical field of the same polarity as the toner particle 1 to the liquid developer layer 201Y described above to thereby unevenly distribute the toner particles at the vicinity of the developing roller 20Y in the liquid developer layer 201Y as shown in FIG. B.

By unevenly distributing the toner particles in this way, it is possible to improve an image density (developing efficiency), and as a result it becomes possible to obtain a high quality clear image.

The developer pressing roller 22Y is provided with a cleaning blade 23Y. The cleaning blade 23Y has a function of removing a liquid developer adhering to the developer pressing roller 22Y.

The developing unit 100Y has a developing roller cleaning blade 21Y made of rubber and provided in contact with the surface of the developing roller 20Y. The developing roller cleaning blade 21Y is a device for scrapping off the liquid developer remaining on the developing roller 20Y after the development of an image has been carried out at the developing position. The liquid developer removed by the developing roller cleaning blade 21Y is collected in the liquid developer storage section 31Y and reused.

Further, the image forming apparatus 1000 has a reuse device for reusing an insulation liquid in the liquid developer collected in the respective developer collecting sections (15, 18, 47, 63).

The reuse device includes a feed line 70 which feeds the liquid developer collected in the respective developer collecting sections, and a filter means 77 for removing a solid matter (toner particles and the like) contained in the liquid developer, and an insulation liquid storage section 74 for storing an insulation liquid from which a solid matter has been removed by the filter means 77.

In the feed line 70, a pump 76 is provided, and by using the pump 76, the liquid developer collected in the respective developer collecting sections is fed to the insulation liquid storage section 74.

The insulation liquid stored in the insulation liquid storage section 74 is fed to the respective developing sections appropriately with a feeding means not shown in the drawing for reuse.

Further, the solid matter removed by the filter means 77 is detected by a detecting means for detecting a state of the filter means (not shown in the drawing). Base on the detected result, the filter means 77 can be replaced. This makes it possible to maintain the filtering function of the filter means 77 stably.

In the foregoing, the invention was described based on the preferred embodiments, but the invention is not limited to these embodiments.

For example, the liquid developer of the present invention is not limited to one that is to be used in the image forming apparatus and the fixing unit as described above, Further, the liquid developer of the present invention is not limited to one produced by the method described above.

Further, in the above described embodiments, an electrolyte is added to the water-based dispersion liquid obtained by removing at least a part of the solvent contained in the water-based emulsion so that the particles of the dispersoid are associated to thereby form associated particles. But the present invention is not limited thereto.

For example, a coloring agent, a monomer of a resin material, a surfactant and a polymerization initiator are dispersed in the water-based liquid, and a water-based dispersion liquid is prepared by an emulsion polymerization, and then an electrolyte is added to the water-based dispersion liquid, so that the particles of the dispersoid are associated to thereby form associated particles (this method is called as "emulsion polymerization association method"). Further, the obtained water-based dispersion liquid is dried by a spry to thereby obtain associated particles.

EXAMPLES

<1> Production of Liquid Developer

Example 1

First, 80 parts by weight of a polyester resin (softening point $T_f$ thereof was 99° C.), and 20 parts by weight of a cyanine pigment ("Pigment Blue 15:3", produced by Dainichiseika Color & Chemicals Mfg. Co., Ltd.) as a coloring agent were prepared. These components were mixed using a 20 L type Henschel mixer to obtain a material for producing toner particles.

Next, the material (mixture) was kneaded using a biaxial kneader-extruder. The kneaded material extruded from an extruding port of the biaxial kneader-extruder was cooled. The kneaded material that had been cooled as described above was coarsely ground using a hammer mill to be formed into powder (ground material) having an average particle size of 1.0 mm or less.

Next, 250 parts by weight of toluene was added to 100 parts by weight of the coarse kneaded material, and then it was subjected to a treatment using an ultrasound homogenizer (output: 400 μA) for one hour to obtain a solution (toner material solution) in which the polyester resin of the kneaded material was dissolved. In the solution, the pigment was finely dispersed homogeneously.

Further, 1 part by weight of sodium-dodecylbenzenesulfonic acid as a dispersant was mixed with 700 parts by weight of ion-exchanged water to obtain a water-based liquid. The water-based liquid was stirred with a homomixer (produced by PRIMIX Corporation) with the number of stirring being adjusted.

The above toner material solution was added drop by drop to the water-based liquid with being stirred, to obtain a water-based emulsion in which a dispersoid comprised of particles having an average particle size of 0.5 μm was homogeneously dispersed.

Thereafter, the toluene contained in the water-based emulsion was removed under the conditions in which a temperature was 100° C. and an ambience pressure was 80 kPa, and after it was cooled to room temperature, a predetermined amount of water was added for condensation adjustment to thereby obtain a water-based dispersion liquid in which solid fine particles were dispersed. In the thus obtained water-based dispersion liquid, substantially no toluene remained.

The concentration of the solid component (dispersoid) of the thus obtained water-based dispersion liquid was 20 wt %. Further, the average particle size of the particles of the dispersoid (solid fine particles) dispersed in the suspension was 0.5 μm.

The measurement of the average particle size was carried out using a laser diffraction/scattering type particle size distribution measurement apparatus ("LA-920", produced by HORIBA Ltd.).

Next, 0.35 parts by weight of nonionic surfactant ("EPAN 450" produced by DAI-ICHI KOGYO SEIYAKU CO., LTD) was added to 100 parts by weight of the thus obtained water-based dispersion liquid with being stirred.

Next, a stirring speed was adjusted, and a temperature was set to 30° C. Thereafter, 35 parts by weight of a 3% ammonium sulfate solution was added drop by drop to 100 parts by weight of the water-based dispersion liquid. In this way, an associated particle dispersion liquid in which associated particles were dispersed was obtained.

The associated particles were separated by a centrifugal machine from the thus obtained the associated particle dispersion liquid. Then, the associated particles were washed. Thereafter, the associated particles were dried by a vacuum dryer to thereby obtain the associated particles. An average particle size of the thus obtained associated particles was 5.2 μm.

Next, chromium carbide beads having an average diameter of 4 mm were prepared in a vessel of 500 mL. Thereafter, 150 parts by weight of soy oil-alcohol ester-exchange liquid ("soy oil fatty acid methyl" produced by The Nisshin OilliO Group, Ltd.) obtained by an ester-exchange reaction of soy oil and methanol, and 2.5 parts by weight of the condensation polymer of polyamine fatty acid as a dispersant ("Solsperse 13900" produced by Lubrizol Japan Ltd.) were put in the vessel.

Next, 100 parts by weight of the thus obtained associated particles were put in the vessel. The associated particles, the chromium carbide beads, the soy oil-alcohol ester-exchange liquid and the condensation polymer of polyamine fatty acid were mixed by a ball mill for 10 minutes for blending the associated particles with the soy oil-alcohol ester-exchange liquid. Thereafter, they were further mixed by the ball mill for 200 hours for disassociating the associated particles, to thereby obtain a toner particle dispersion liquid.

After the completion of the disassociation process, 225 parts by weight of rape oil (produced by The Nisshin Oillio Group, Ltd.) and 1.4 parts by weight of zinc oxide (an average particles size of zinc oxide was 2.0 μm) as a charge control agent were added to the vessel, so that an insulation liquid in which the toner particles were dispersed was obtained.

The dispersion of the toner particles was carried out by a ball mill using beads having a diameter of 1 mm for 24 hours, and then the beads were removed. In this way, a liquid developer was obtained.

In the thus obtained liquid developer, a average particle size of the toner particles was 1.5 μm, and a standard deviation of the particle size between the toner particles was 0.50 μm. Further, a viscosity of the liquid developer measured by using a vibration type viscometer at a temperature of 25° C. according to JIS Z 8809 was 265 mPa·s.

An amount of oleic acid component contained in the rape oil was 80 mol %. Further, an electric resistance of the insulation liquid was $2.6\times10^{13}$ Ωcm, and an electric resistance of the liquid developer was $3.1\times10^{12}$ Ωcm.

Examples 2 and 3

In each of Examples 2 and 3, a liquid developer was produced in the same manner as in the Example 1 except that the amount of the soy oil-alcohol ester-exchange liquid and the amount of the rape oil were changed to those shown in Table 1.

Example 4

In Example 4, a liquid developer was produced in the same manner as in the Example 1 except that "soy oil fatty acid buthyl", (produced by The Nisshin OilliO Group, Ltd.) obtained by an ester-exchange reaction of soy oil and buthanol was used as the soy oil-alcohol ester-exchange liquid.

Example 5

In Example 5, a liquid developer was produced in the same manner as in the Example 1 except that the charge control agent was changed to that shown in Table 1.

Example 6

In Example 6, a liquid developer was produced in the same manner as in the Example 1 except that the condensation polymer of polyamine fatty acid was not added.

Example 7

In Example 7, a liquid developer was produced in the same manner as in the Example 1 except that a sunflower oil-alcohol ester-exchange liquid (produced by The Nisshin OilliO Group, Ltd.) obtained by an ester-exchange reaction of the sunflower oil and methanol was used instead of the soy oil-alcohol ester-exchange liquid, and higholeic (HO) sunflower oil ("Oleinrich" produced by SHOWA SANGYO, Ltd.) was used instead of the rape oil.

Example 8

In Example 8, a liquid developer was produced in the same manner as in the Example 1 except that a palm oil-alcohol ester-exchange liquid ("EXCEPARL MC" produced by KAO Corporation) obtained by an ester-exchange reaction of palm oil and methanol was used instead of the soy oil-alcohol ester-exchange liquid, and palm oil ("Coconuts oil" produced by KANEDA ABURA TEN) was used instead of the rape oil.

Example 9

In Example 9, a liquid developer was produced in the same manner as in the Example 8 except that HIGHOLEIC (HO) sunflower oil (produced by The Nisshin OilliO Group, Ltd.) was used instead of the palm oil ("Coconuts oil" produced by Kaneda Shoji Co., Ltd.).

Example 10

In Example 10, a liquid developer was produced in the same manner as in the Example 7 except that a safflower oil-alcohol ester-exchange liquid (produced by The Nisshin OilliO Group, Ltd.) obtained by an ester-exchange reaction of safflower oil and ethanol was used instead of the sunflower oil-alcohol ester-exchange liquid (produced by The Nisshin OilliO Group, Ltd.).

Example 11

In Example 11, a liquid developer was produced in the same manner as in the Example 10 except that palm oil ("Coconuts oil" produced by Kaneda Shoji Co., Ltd.) was used instead of the sunflower oil.

Comparative Example 1

A coarse kneaded material was obtained in the same manner as in the Example 1.

Next, 100 parts by weight of the thus obtained coarse kneaded material and 150 parts by weight of soy oil (produced by The Nisshin OilliO Group, Ltd.) were prepared. The coarse kneaded material and the soy oil were put in a ball mill, and then they were milled by a wet crushing process for 400 hours. As a result, a dispersion liquid of the kneaded material was obtained.

Thereafter, 100 parts by weight of the thus obtained dispersion liquid of the kneaded material, 225 parts by weight of the soy oil and 1.4 parts by weight of zinc oxide as a charge control agent were mixed, to thereby obtain a liquid developer.

In the thus obtained liquid developer, an average particle size of toner particles was 4.8 μm, and a standard deviation between toner particles was 2.86 μm.

Further, an electric resistance of the insulation liquid was $1.2\times10^{13}$ Ωcm, and an electric resistance of the liquid developer was $3.1\times10^{12}$ Ωcm. Further, a viscosity of the liquid developer measured by using a vibration type viscometer at a temperature of 25° C. according to JIS Z 8809 was 490 mPa·s.

Comparative Example 2

In Comparative Example 2, a liquid developer was produced in the same manner as in the Comparative Example 1 except that a soy oil-alcohol ester-exchange liquid ("soy oil fatty acid methyl" produced by The Nisshin OilliO Group, Ltd.) obtained by an ester-exchange reaction of soy oil and methanol was used instead of the soy oil.

Comparative Example 3

In Comparative Example 3, associated particles were produced in the same manner as in the Example 1.

Next, chromium carbide beads having an average particle size of 4 mm were prepared in a vessel of 500 mL. Thereafter, 150 parts by weight of soy oil (produced by The Nisshin OilliO Group, Ltd.) and 2.5 parts by weight of condensation polymer of polyamine fatty acid as the dispersant ("Solsperse 13940" produced by Lubrizol Japan Ltd.) were put in the vessel.

Next, 100 parts by weight of the thus obtained associated particles were put in the vessel. The associated particles, the chromium carbide beads, the soy oil, and the polycondensation polymer were mixed by a ball mill for 10 minutes. Thereafter, they were further mixed by the ball mill for 200 hours for disassociating the associated particles, to thereby obtain a toner particle dispersion liquid.

After complete of the disassociation process, 225 of parts by weight of soy oil and 1.4 of parts by weight of zinc oxide (an average particles size of zinc oxide was 2.0 μm.) as a charge control agent were added to the vessel so that the toner particles were dispersed. The dispersion of the toner particles was carried out by a ball mill using beads having a diameter of 1 mm for 24 hours, and then the beads were removed. In this way, a liquid developer was obtained.

In the thus obtained liquid developer, an average particle size of the toner particles was 5.3 μm, and a standard deviation in the particle sizes between the toner particles was 2.41 μm. Further, a viscosity of the liquid developer measured by using a vibration type viscometer at a temperature of 25° C. according to JIS Z 8809 was 505 mPa·s. Further, an electric resistance of the insulation liquid was $1.2\times10^{13}$ Ωcm, and an electric resistance of the liquid developer was $3.1\times10^{12}$ Ωcm.

Comparative Example 4

In Comparative Example 4, a liquid developer was produced in the same manner as in the Comparative Example 3 except that a soy oil-alcohol ester-exchange liquid ("soy oil fatty acid methyl" produced by The Nisshin OilliO Group, Ltd.) obtained by an ester-exchange reaction of soy oil and methanol was used instead of the soy oil.

For the Examples 1 to 11 and the Comparative Examples 1 to 4, the kinds of resins, vegetable oils and vegetable oil-alcohol ester-exchange liquids used, the amounts of the vegetable oil and the vegetable oil-alcohol ester-exchange liquid contained in each insulation liquid, the electric resistance of each insulation liquid, and the viscosity of each liquid developer and the like were shown in Table 1. Note that in the Table 1 "PEs" represents polyester resin.

TABLE 1

| | Liquid developer | | | | | | | |
|---|---|---|---|---|---|---|---|---|
| | | Insulation liquid | | | | | | |
| | | | | | Vegetable oil-alcohol ester-exchange liquid | | | |
| | | Vegetable oil | | | | | | |
| | Resin | Kind | Amount of oleic acid [mol %] | Amount of vegetable oil in insulation liquid: X [wt %] | Vegetable oil | Alcohol | Amount of oleic acid [mol %] | Amount of vegetable oil-alcohol ester-exchange liquid in insulation liquid: Y [wt %] |
| Ex. 1 | PEs | Rape oil | 80 | 60 | Soy oil | Methanol (carbon number 1) | — | 40 |
| Ex. 2 | PEs | Rape oil | 80 | 70 | Soy oil | Methanol (carbon number 1) | — | 30 |
| Ex. 3 | PEs | Rape oil | 80 | 40 | Soy oil | Methanol (carbon number 1) | — | 60 |
| Ex. 4 | PEs | Rape oil | 80 | 60 | Soy oil | Butanol (carbon number 4) | — | 40 |
| Ex. 5 | PEs | Rape oil | 80 | 60 | Soy oil | Methanol (carbon number 1) | — | 40 |
| Ex. 6 | PEs | Rape oil | 80 | 60 | Soy oil | Methanol (carbon number 1) | — | 40 |
| Ex. 7 | PEs | HO Sunflower oil | 83 | 60 | Sunflower oil | Methanol (carbon number 1) | 83 | 40 |
| Ex. 8 | PEs | Palm oil | 7.5 | 60 | Palm oil | Methanol (carbon number 1) | 7.5 | 40 |
| Ex. 9 | PEs | HO Safflower oil | 77 | 60 | Palm oil | Methanol (carbon number 1) | 7.5 | 40 |
| Ex. 10 | PEs | HO Sunflower oil | 83 | 60 | HO Safflower oil | Ethanol(carbon number 2) | 77 | 40 |
| Ex. 11 | PEs | Palm oil | 7.5 | 60 | HO Safflower oil | Ethanol(carbon number 2) | 77 | 40 |
| Comp. Ex. 1 | PEs | Soy oil | — | 100 | — | — | — | — |
| Comp. Ex. 2 | PEs | — | — | — | Soy oil | Methanol (carbon number 1) | — | 100 |
| Comp. Ex. 3 | PEs | Soy oil | — | 100 | — | — | — | — |
| Comp. Ex. 4 | PEs | — | — | — | Soy oil | Methanol (carbon number 1) | — | 100 |

| | Liquid developer | | | | | | |
|---|---|---|---|---|---|---|---|
| | | | Charge control agent | | Existence of | | |
| | Insulation liquid | | | Average | condensation | | |
| | X/Y | Electric resistance [Ωcm] | Kind | particle size [μm] | polymer of polyamine fatty acid | viscosity [mPa · S] | Electric resistance [Ωcm] |
| Ex. 1 | 1.5 | $2.6 \times 10^{13}$ | ZnO | 2.0 | Yes | 265 | $3.1 \times 10^{12}$ |
| Ex. 2 | 2.33 | $3.0 \times 10^{13}$ | ZnO | 2.0 | Yes | 326 | $3.7 \times 10^{12}$ |
| Ex. 3 | 0.67 | $1.8 \times 10^{13}$ | ZnO | 2.0 | Yes | 159 | $2.2 \times 10^{12}$ |
| Ex. 4 | 1.5 | $2.6 \times 10^{13}$ | ZnO | 2.0 | Yes | 235 | $2.3 \times 10^{12}$ |
| Ex. 5 | 1.5 | $2.6 \times 10^{13}$ | $Al_2O_3$ | 2.0 | Yes | 228 | $3.0 \times 10^{12}$ |
| Ex. 6 | 1.5 | $2.6 \times 10^{13}$ | ZnO | 2.0 | No | 241 | $3.2 \times 10^{12}$ |
| Ex. 7 | 1.5 | $2.3 \times 10^{13}$ | ZnO | 2.0 | Yes | 235 | $2.7 \times 10^{12}$ |
| Ex. 8 | 1.5 | $5.1 \times 10^{13}$ | ZnO | 2.0 | Yes | 235 | $3.5 \times 10^{12}$ |
| Ex. 9 | 1.5 | $2.5 \times 10^{13}$ | ZnO | 2.0 | Yes | 235 | $2.1 \times 10^{12}$ |
| Ex. 10 | 1.5 | $2.5 \times 10^{13}$ | ZnO | 2.0 | Yes | 235 | $2.4 \times 10^{12}$ |
| Ex. 11 | 1.5 | $5.8 \times 10^{13}$ | ZnO | 2.0 | Yes | 235 | $4.8 \times 10^{12}$ |

TABLE 1-continued

| | | | | | | | |
|---|---|---|---|---|---|---|---|
| Comp. Ex. 1 | — | $1.2 \times 10^{13}$ | ZnO | 2.0 | No | 490 | $3.1 \times 10^{12}$ |
| Comp. Ex. 2 | — | $2.0 \times 10^{12}$ | ZnO | 2.0 | No | 40 | $5.3 \times 10^{12}$ |
| Comp. Ex. 3 | — | $1.2 \times 10^{13}$ | ZnO | 2.0 | Yes | 505 | $3.1 \times 10^{12}$ |
| Comp. Ex. 4 | — | $2.0 \times 10^{12}$ | ZnO | 2.0 | Yes | 45 | $5.3 \times 10^{11}$ |

<2> Evaluation

For the respective liquid developers produced as described above, the following evaluations were made.

<2.1> Fixing Strength (Fixing Characteristics)

By using the image forming apparatus shown in FIG. 1 images each having a predetermined pattern were formed on recording papers (High quality paper LPCPPA4 produced by Seiko Epson Corporation) employing the liquid developers of the Examples 1 to 11 and the Comparative Examples 1 to 4, respectively. Then, the images formed on the papers were thermally fixed onto the papers using a fixing apparatus as shown in FIG. 3. The thermal fixing was carried out by setting a temperature of a heat fixing roller at 100° C.

Thereafter, after it was confirmed as to whether or not a non-offset area was present, the fixed image on each of the papers was rubbed out twice using a sand eraser ("LION 261-11", Product of LION OFFICE PRODUCTS CORP.) with a pressure loading of 1.0 kgf/cm$^2$. Then, the residual rate of the image density of each recording paper was measured by a calorimeter "X-Rite model 404" (X-Rite Incorporated), and the measurement results were evaluated according to the following five criteria.

A: Residual rate of the image density was 95% or higher.

B: Residual rate of the image density was 90% or higher but lower than 95%.

C: Residual rate of the image density was 80% or higher but lower than 90%.

D: Residual rate of the image density was 70% or higher but lower than 80%.

E: Residual rate of the image density was lower than 70%.

<2.2> Charge Property

A potential difference of each of the liquid developers obtained in the Examples 1 to 11 and the Comparative Examples 1 to 4 was measured by using a microscope type laser zeta potential meter (ZC-2000 produced by Microtec Nition Corporation), and the measurement results were evaluated according to the following five criteria.

A: Potential difference was +100 mV or higher.

B: Potential difference was +85 mV or higher but lower than +100 mV.

C: Potential difference was +70 mV or higher but lower than +85 mV.

D: Potential difference was +50 mV or higher but lower than +70 mV.

E: Potential difference was lower than +50 mV.

<2.3> Dispersion Stability Test

The liquid developer of 10 ml obtained in each of the Examples 1 to 11 and the Comparative Examples 1 to 4 was supplied to a centrifugation tube. After the liquid developer was separated under the conditions in which a gravitational acceleration was 1,000 G and a time was 10 minutes, a supernatant fluid of 200 ml was gathered. The liquid developers used in the Examples 1 to 11 and the Comparative Examples 1 to 4 were diluted to 100 times respectively, and they were used as samples.

An absorption wavelength of each of the samples was measured using a spectrophotometer for ultraviolet and visible region (V-570 produced by JASCO Corporation).

For each of the samples, an absorbance in the absorption range for a cyan pigment (that is, at the absorption wavelength of 685 nm) was measured, and the results were evaluated according to the following four criteria.

A: Absorbance at the absorption wavelength of 685 nm was 1.50 or higher (Settling of toner particles were not observed at all.).

B: Absorbance at the absorption wavelength of 685 nm was 1.00 or higher but lower than 1.50 (Settling of toner particles were scarcely observed.).

C: Absorbance at the absorption wavelength of 685 nm was 0.50 or higher but lower than 1.00 (Settling of toner particles were observed.).

D: Absorbance at the absorption wavelength of 685 nm was lower than 0.50 (A settling of toner particles were conspicuously observed, and the settling began in a state that the sample was being left in a natural condition.).

<2.4> Preservability

The liquid developers obtained in the Examples 1 to 11 and the Comparative Examples 1 to 4 were being placed under the atmosphere in which temperature was changed in the range of 15 to 25° C. for six months. Thereafter, conditions of the toner particles in the liquid developers were visually observed, and the observation results were evaluated by the following five criteria.

A: Suspension of toner particles and aggregation and settling of toner particles were not observed at all.

B: Suspension of toner particles and aggregation and settling of toner particles were scarcely observed.

C: Suspension of toner particles and aggregation and settling of toner particles were slightly observed, but they were within the range where the liquid developer could be practically used.

D: Suspension of toner particles and aggregation and settling of toner particles were clearly observed.

E: Suspension of toner particles and aggregation and settling of toner particles were conspicuously observed.

<2.5> Environmental Stability (Storage Stability)

The liquid developers obtained in the Examples 1 to 14 and the Comparative Examples 1 to 4 were being placed under the atmosphere at a temperature of 35° C. and a relative humidity of 65% for six months. Thereafter, conditions of the liquid developers were visually observed, and the observation results were evaluated by the following five criteria.

A: Increased viscosity and color change of the liquid developer were not observed at all.

B: Increased viscosity and color change of the liquid developer were scarcely observed.

C: Increased viscosity and color change of the liquid developer were slightly observed, but they were within the range where the liquid developer could be practically used.

D: Increased viscosity and color change of the liquid developer were clearly observed.

E: Increased viscosity and color change of the liquid developer were conspicuously observed.

<2.6> Peel Strength

By using the image forming apparatus shown in FIG. 1, images each having a predetermined pattern were formed on recording papers (High quality paper LPCPPA4 produced by Seiko Epson Corporation) employing the liquid developers of the Examples 1 to 11 and the Comparative Examples 1 to 4, respectively.

Then, the images formed on the papers were thermally fixed onto the recoding papers using a fixing apparatus as shown in FIG. 3. The thermal fixing was carried out by setting a temperature of a heat fixing roller at 180° C.

Thereafter, after it was confirmed as to whether or not a non-offset area was present, a mending tape (Product code 810-1-18 produced by Scotch Corporation) was stuck onto the fixed image on each of the recoding papers, and then the mending tape was peeled off from the paper by pulling the end of the tape to a direction defining an angle of 170° between a surface of the paper and the upper surface of the tape at a speed of 5 cm/s.

Then, the residual rate of the image density of each recording paper was measured by a calorimeter ("X-Rite model 528", produced by X-Rite Incorporated), and the measurement results were evaluated according to the following five criteria.

A: Residual rate of the image density was 95% or higher.

B: Residual rate of the image density was 90% or higher but lower than 95%

C: Residual rate of the image density was 80% or higher but lower than 90%

D: Residual rate of the image density was 70% or higher but lower than 80%

E: Residual rate of the image density was lower than 70%

These results are shown in the following Table 2.

TABLE 2

| | Evaluation | | | | | |
|---|---|---|---|---|---|---|
| | Fixing strength | Charge property | Dispersion stability | Preservability | Environmental stability | Peel strength |
| Ex. 1 | A | A | A | A | A | A |
| Ex. 2 | B | A | A | B | A | B |
| Ex. 3 | A | B | A | A | B | A |
| Ex. 4 | A | B | A | A | A | A |
| Ex. 5 | A | A | A | A | A | A |
| Ex. 6 | A | A | B | B | B | A |
| Ex. 7 | A | C | B | B | B | A |
| Ex. 8 | B | C | B | B | B | B |
| Ex. 9 | B | C | B | B | B | B |
| Ex. 10 | B | C | B | B | B | B |
| Ex. 11 | B | C | B | B | B | B |
| Comp. Ex. 1 | D | E | C | E | D | D |
| Comp. Ex. 2 | E | E | C | D | C | D |
| Comp. Ex. 3 | D | D | C | E | D | D |
| Comp. Ex. 4 | E | E | C | D | C | D |

As shown in the Table 2, the liquid developers according to the invention (that is, the liquid developers of the Examples 1 to 11) had excellent fixing strength and excellent charge property. Further, the liquid developers had excellent dispersion stability, preservability, and storage stability. In contrast, in the liquid developers of the Comparative Examples 1 to 4, satisfactory results could not be obtained.

Figure 9:
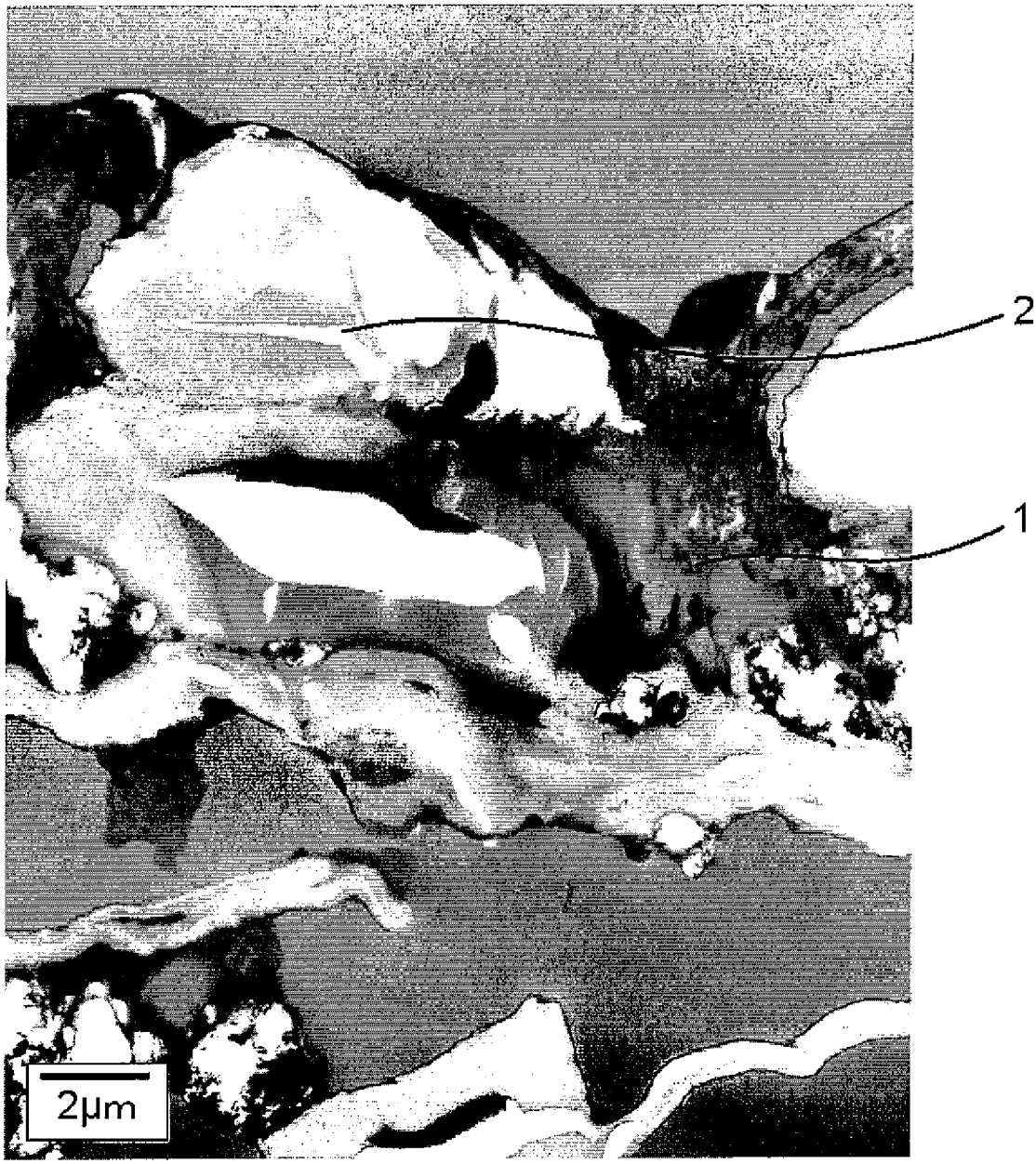
FIG. 9 is a photograph taken by a scanning electron microscope for the cross section of the recording paper on which an image was formed using the liquid developer of the Example 1.

FIG. 9 is a photograph taken by a scanning electron microscope for the cross section of the recording paper on which an image was formed using the liquid developer of the Example 1. As shown in FIG. 9, it was observed that the toner particles were entered into the spaces of the paper fibers of the recording paper. Further, in the liquid developers of the Example 2 to 11, results similar to those of the Example 1 could be obtained.

In contrast, in the liquid developers of the Comparative Examples 1 and 3, the toner particles remained on surface of the recording papers. And the toner particles that were entered into the spaces of the paper fibers of the recording paper could not be obtained.

Furthermore, liquid developers which are the same as those described above were produced excepting that as a coloring agent a pigment red 122, a pigment yellow 180, and a carbon black ("Printex L", produced by Degussa AG) were used instead of the cyanogen-based pigment, and they were evaluated in the same manner as described above. As a result, substantially the same results could be obtained.

<3> Production of Liquid Developer

Example 12

First, 80 parts by weight of a polyester resin (softening point $T_f$ thereof was 99° C.), and 20 parts by weight of a cyanine pigment ("Pigment Blue 15:3", produced by Dainichiseika Color & Chemicals Mfg. Co., Ltd.) as a coloring agent were prepared. These components were mixed using a 20 L type Henschel mixer to obtain a material for producing toner particles.

Next, the material (mixture) was kneaded using a biaxial kneader-extruder. The kneaded material extruded from an extruding port of the biaxial kneader-extruder was cooled. The kneaded material that had been cooled as described above was coarsely ground using a hammer mill to be formed into powder (ground material) having an average particle size of 1.0 mm or less.

Next, 250 parts by weight of toluene was added to 100 parts by weight of the coarse kneaded material, and then it was subjected to a treatment using an ultrasound homogenizer (output: 400 μA) for one hour to obtain a solution (toner material solution) in which the polyester resin of the kneaded material was dissolved. In the solution, the pigment was finely dispersed homogeneously.

Further, 1 part by weight of sodium-dodecylbenzenesulfonic acid as a dispersant was mixed with 700 parts by weight of ion-exchanged water to obtain a water-based liquid. The water-based liquid was stirred with a homomixer (produced by PRIMIX Corporation) with the number of stirring being adjusted.

The above toner material solution was added drop by drop to the water-based liquid with being stirred, to obtain a water-based emulsion in which a dispersoid comprised of particles having an average particle size of 0.5 μm was homogeneously dispersed.

Thereafter, the toluene contained in the water-based emulsion was removed under the conditions in which a temperature was 100° C. and an ambience pressure was 80 kPa, and after it was cooled to room temperature, a predetermined amount of water was added for condensation adjustment to thereby obtain a water-based dispersion liquid in which solid fine particles were dispersed. In the thus obtained water-based dispersion liquid, substantially no toluene remained.

The concentration of the solid component (dispersoid) of the thus obtained water-based dispersion liquid was 20 wt %. Further, the average particle size of the particles of the dispersoid (solid fine particles) dispersed in the suspension was 0.5 μm.

The measurement of the average particle size was carried out using a laser diffraction/scattering type particle size distribution measurement apparatus ("LA-920", produced by HORIBA Ltd.).

Next, 0.35 parts by weight of nonionic surfactant ("EPAN 450" produced by DAI-ICHI KOGYO SEIYAKU CO., LTD) was added to 100 parts by weight of the thus obtained water-based dispersion liquid with being stirred.

Next, a stirring speed was adjusted, and a temperature was set to 30° C. Thereafter, 35 parts by weight of a 3% ammonium sulfate solution was added drop by drop to 100 parts by weight of the water-based dispersion liquid. In this way, an associated particle dispersion liquid in which associated particles were dispersed was obtained.

The associated particles were separated by a centrifugal machine from the thus obtained the associated particle dispersion liquid. Then, the associated particles were washed. Thereafter, the associated particles were dried by a vacuum dryer to thereby obtain the associated particles. An average particle size of the thus obtained associated particles was 5.2 μm.

Next, chromium carbide beads having an average diameter of 4 mm were prepared in a vessel of 500 mL. Thereafter, 150 parts by weight of rape oil-alcohol ester-exchange liquid ("rape oil fatty acid methyl" produced by The Nisshin OilliO Group, Ltd.) obtained by an ester-exchange reaction of rape oil and methanol, and 2.5 parts by weight of the condensation polymer of polyamine fatty acid as a dispersant ("Solsperse 13940" produced by Lubrizol Japan Ltd.) were put in the vessel. Further, an amount of oleic acid component contained in the rape oil-alcohol ester-exchange liquid was 80 mol %.

Next, 100 parts by weight of the thus obtained associated particles were put in the vessel. The associated particles, the chromium carbide beads, the rape oil-alcohol ester-exchange liquid and the condensation polymer of polyamine fatty acid were mixed by a ball mill for 10 minutes for blending the associated particles with the rape oil-alcohol ester-exchange liquid. Thereafter, they were further mixed by the ball mill for 200 hours for disassociating the associated particles, to thereby obtain a toner particle dispersion liquid.

After the completion of the disassociation process, 225 parts by weight of soy oil and 1.4 parts by weight of zinc oxide (an average particles size of zinc oxide was 2.0 μm) as a charge control agent were added to the vessel, so that an insulation liquid in which the toner particles were dispersed was obtained.

The dispersion of the toner particles was carried out by a ball mill using beads having a diameter of 1 mm 24 hours, and then the beads were removed. In this way, a liquid developer was obtained.

In the thus obtained liquid developer, an average particle size of the toner particles was 1.4 μm, and a standard deviation of the particle size between the toner particles was 0.50 μm. Further, a viscosity of the liquid developer measured by using a vibration type viscometer at a temperature of 25° C. according to JIS Z 8809 was 245 mPa·s.

Further, an electric resistance of the insulation liquid was $7.0\times10^{12}$ Ωcm, and an electric resistance of the liquid developer was $2.2\times10^{12}$ Ωcm.

Examples 13

In Examples 13, a liquid developer was produced in the same manner as in the Example 12 except that the amount of the rape oil-alcohol ester-exchange liquid and the amount of the soy oil were changed to those shown in Table 3.

Example 14

In Example 14, a liquid developer was produced in the same manner as in the Example 12 except that an amount of oleic acid component contained in the rape oil-alcohol ester-exchange liquid was 70 mol % (produced by The Nisshin OilliO Group, Ltd.).

Example 15

In Example 15, a liquid developer was produced in the same manner as in the Example 12 except that "rape oil fatty acid ethyl" (produced by The Nisshin OilliO Group, Ltd.) obtained by an ester-exchange reaction of rape oil and ethanol was used as the rape oil-alcohol ester-exchange liquid.

Example 16

In Example 16, a liquid developer was produced in the same manner as in the Example 12 except that the charge control agent was changed to that shown in Table 3.

Example 17

In Example 17, a liquid developer was produced in the same manner as in the Example 12 except that the condensation polymer of polyamine fatty acid was not added.

A liquid developer was produced in the same manner as in the Comparative Example 1 to 4.

For the Examples 12 to 17 and the Comparative Examples 1 to 4, the kinds of resins, vegetable oils and vegetable oil-alcohol ester-exchange liquids used, the amounts of the vegetable oil and the vegetable oil-alcohol ester-exchange liquid contained in each insulation liquid, the electric resistance of each insulation liquid, and the viscosity of each liquid developer and the like were shown in Table 3. Note that in Table 3 "PEs" represents polyester resin.

TABLE 3

| | Liquid developer | | | | | | | |
|---|---|---|---|---|---|---|---|---|
| | | Insulation liquid | | | | | | |
| | | | | | Vegetable oil-alcohol ester-exchange liquid | | | |
| | | Vegetable oil | | | | | | |
| | Resin | Kind | Amount of oleic acid [mol %] | Amount of vegetable oil in insulation liquid: X [wt %] | Vegetable oil | Alcohol | Amount of oleic acid [mol %] | Amount of vegetable oil-alcohol ester-exchange liquid in insulation liquid: Y [wt %] |
| Ex. 12 | PEs | Soy oil | 80 | 60 | Rape oil | Methanol (carbon number 1) | — | 40 |
| Ex. 13 | PEs | Soy oil | 80 | 40 | Rape oil | Methanol (carbon number 1) | — | 60 |
| Ex. 14 | PEs | Soy oil | 70 | 60 | Rape oil | Methanol (carbon number 1) | — | 40 |
| Ex. 15 | PEs | Soy oil | 80 | 60 | Rape oil | Ethanol (carbon number 2) | — | 40 |
| Ex. 16 | PEs | Soy oil | 80 | 60 | Rape oil | Methanol (carbon number 1) | — | 40 |
| Ex. 17 | PEs | Soy oil | 80 | 60 | Rape oil | Methanol (carbon number 1) | — | 40 |
| Comp. Ex. 1 | PEs | Soy oil | — | 100 | — | — | — | — |
| Comp. Ex. 2 | PEs | — | — | — | Soy oil | Methanol (carbon number 1) | — | 100 |
| Comp. Ex. 3 | PEs | Soy oil | — | 100 | — | — | — | — |
| Comp. Ex. 4 | PEs | — | — | — | Soy oil | Methanol (carbon number 1) | — | 100 |

| | Liquid developer | | | | | | |
|---|---|---|---|---|---|---|---|
| | Insulation liquid | | Charge control agent | | Existence of condensation polymer of polyamine fatty acid | | |
| | X/Y | Electric resistance [Ωcm] | Kind | Average particle size [μm] | | viscosity [mPa · S] | Electric resistance [Ωcm] |
| Ex. 12 | 1.5 | $7.0 \times 10^{12}$ | ZnO | 2.0 | Yes | 245 | $2.2 \times 10^{12}$ |
| Ex. 13 | 0.67 | $5.0 \times 10^{12}$ | ZnO | 2.0 | Yes | 137 | $1.9 \times 10^{12}$ |
| Ex. 14 | 1.5 | $7.0 \times 10^{12}$ | ZnO | 2.0 | Yes | 225 | $2.8 \times 10^{12}$ |
| Ex. 15 | 1.5 | $7.0 \times 10^{12}$ | ZnO | 2.0 | Yes | 226 | $2.4 \times 10^{12}$ |
| Ex. 16 | 1.5 | $7.0 \times 10^{12}$ | MgO | 2.0 | Yes | 228 | $2.0 \times 10^{12}$ |
| Ex. 17 | 1.5 | $7.0 \times 10^{13}$ | ZnO | 2.0 | No | 228 | $2.2 \times 10^{12}$ |
| Comp. Ex. 1 | — | $1.2 \times 10^{13}$ | ZnO | 2.0 | No | 490 | $3.1 \times 10^{12}$ |
| Comp. Ex. 2 | — | $2.0 \times 10^{12}$ | ZnO | 2.0 | No | 40 | $5.3 \times 10^{11}$ |
| Comp. Ex. 3 | — | $1.2 \times 10^{13}$ | ZnO | 2.0 | Yes | 505 | $3.1 \times 10^{12}$ |
| Comp. Ex. 4 | — | $2.0 \times 10^{12}$ | ZnO | 2.0 | Yes | 45 | $5.3 \times 10^{11}$ |

<4> Evaluation

For the respective liquid developers produced as described above, the same evaluations as those for the above-described 21 2> excepting <2.2> "Charge Property" were made. In addition, the following evaluation, <4.1> was also made.

<4.1> Gloss Level of Toner Images

By using the image forming apparatus shown in FIG. 1 images each having a predetermined pattern were formed on recording papers (High quality paper LPCPPA4 produced by Seiko Epson Corporation) employing the liquid developers of the Examples 12 to 17 and the Comparative Examples 1 to 4, respectively. Then, the images formed on the papers were thermally fixed onto the papers using a fixing apparatus as shown in FIG. 3. The thermal fixing was carried out by setting a temperature of a heat fixing roller at 100° C.

A gloss level of each of the images formed on the recording papers using the liquid developers obtained in the Examples 12 to 17 and the Comparative Examples 1 to 4 was measured using a gloss meter ("GM-26D" produced by MURAKAMI COLOR RESEARCH LABORATORY), and the measurement results were evaluated according to the following four criteria.

A: Gloss level of the toner image on the recording paper was 7 or higher.

B: Gloss level of the toner image on the recording paper was 6 or higher but lower than 7.

C: Gloss level of the toner image on the recording paper was 5 or higher but lower than 6.

D: Gloss level of the toner image on the recording paper was lower than 5.

These results are shown in the following Table 4.

TABLE 4

| | Evaluation | | | | | |
|---|---|---|---|---|---|---|
| | Fixing strength | Gloss | Dispersion stability | Preservability | Environmental stability | Peel strength |
| Ex. 12 | A | A | A | A | A | A |
| Ex. 13 | B | B | A | B | A | A |
| Ex. 14 | A | A | A | A | B | A |
| Ex. 15 | A | A | A | A | A | A |
| Ex. 16 | A | A | A | A | A | A |
| Ex. 17 | B | B | B | B | B | A |
| Comp. Ex. 1 | D | C | C | E | D | D |
| Comp. Ex. 2 | E | D | C | D | C | D |
| Comp. Ex. 3 | D | C | C | E | D | D |
| Comp. Ex. 4 | E | D | C | D | C | D |

As shown in the Table 4, the liquid developers of the invention (that is, the liquid developers of the Examples 12 to 17) had excellent fixing strength and excellent gloss level of images formed on the recording paper.

Further, the liquid developers of the invention had excellent dispersion stability, preservability, and environmental stability (storage stability). In contrast, in the liquid developers of the Comparative Examples 1 to 4, satisfactory results could not be obtained.

The cross section of the recording paper on which an image was formed using the liquid developer of each of the Examples 12 to 17 was observed by a scanning electron microscope, and as a result, it was observed that the toner particles were entered into the spaces of the paper fibers of the recording paper as is the same with the recorded toner images of the Examples 1 to 11.

Furthermore, liquid developers which are the same as those described above were produced excepting that as a coloring agent a pigment red 122, a pigment yellow 180, and a carbon black ("Printex L", produced by Degussa AG) were used instead of the cyanogen-based pigment, and they were evaluated in the same manner as described above. As a result, substantially the same results could be obtained.

<5> Production of Liquid Developer

Example 18

First, 80 parts by weight of a polyester resin (softening point $T_f$ thereof was 99° C.), and 20 parts by weight of a cyanine pigment ("Pigment Blue 15:3", produced by Dainichiseika Color & Chemicals Mfg. Co., Ltd.) as a coloring agent were prepared. These components were mixed using a 20 L type Henschel mixer to obtain a material for producing toner particles.

Next, the material (mixture) was kneaded using a biaxial kneader-extruder. The kneaded material extruded from an extruding port of the biaxial kneader-extruder was cooled. The kneaded material that had been cooled as described above was coarsely ground using a hammer mill to be formed into powder (ground material) having an average particle size of 1.0 mm or less.

Next, 250 parts by weight of toluene was added to 100 parts by weight of the coarse kneaded material, and then it was subjected to a treatment using an ultrasound homogenizer (output: 400 μA) for one hour to obtain a solution (toner material solution) in which the polyester resin of the kneaded material was dissolved. In the solution, the pigment was finely dispersed homogeneously.

Further, 1 part by weight of sodium-dodecylbenzenesulfonic acid as a dispersant was mixed with 700 parts by weight of ion-exchanged water to obtain a water-based liquid. The water-based liquid was stirred with a homomixer (produced by PRIMIX Corporation) with the number of stirring being adjusted.

The above toner material solution was added drop by drop to the water-based liquid with being stirred, to obtain a water-based emulsion in which a dispersoid comprised of particles having an average particle size of 0.5 μm was homogeneously dispersed.

Thereafter, the toluene contained in the water-based emulsion was removed under the conditions in which a temperature was 100° C. and an ambience pressure was 80 kPa, and after it was cooled to room temperature, a predetermined amount of water was added for condensation adjustment to thereby obtain a water-based dispersion liquid in which solid fine particles were dispersed. In the thus obtained water-based dispersion liquid, substantially no toluene remained.

The concentration of the solid component (dispersoid) of the thus obtained water-based dispersion liquid was 20 wt %. Further, the average particle size of the particles of the dispersoid (solid fine particles) dispersed in the suspension was 0.5 μm.

The measurement of the average particle size was carried out using a laser diffraction/scattering type particle size distribution measurement apparatus ("LA-920", produced by HORIBA Ltd.).

Next, 0.35 parts by weight of nonionic surfactant ("EPAN 4501" produced by DAI-ICHI KOGYO SEIYAKU CO., LTD) was added to 100 parts by weight of the thus obtained water-based dispersion liquid with being stirred.

Next, a stirring speed was adjusted, and a temperature was set to 30° C. Thereafter, 35 parts by weight of a 3% ammonium sulfate solution was added drop by drop to 100 parts by the weight of water-based dispersion liquid. In this way, an associated particle dispersion liquid in which associated particles were dispersed was obtained.

The associated particles were separated by a centrifugal machine from the thus obtained the associated particle dispersion liquid. Then, the associated particles were washed. Thereafter, the associated particles were dried by a vacuum dryer to thereby obtain the associated particles. An average particle size of the thus obtained associated particles was 5.2 μm.

Next, chromium carbide beads having an average diameter of 4 mm were prepared in a vessel of 500 mL. Thereafter, 150 parts by weight of soy oil-alcohol ester-exchange liquid ("soy oil fatty acid methyl" produced by The Nisshin OilliO Group, Ltd.) obtained by an ester-exchange reaction of soy oil and methanol, and 2.5 parts by weight of the condensation polymer of polyamine fatty acid as a dispersant ("Solsperse 13900" produced by Lubrizol Japan Ltd.) were put in the vessel.

Next, 100 parts by weight of the thus obtained associated particles were put in the vessel. The associated particles, the chromium carbide beads, the soy oil-alcohol ester-exchange liquid and the condensation polymer of polyamine fatty acid were mixed by a ball mill for 10 minutes for blending the associated particles with the soy oil-alcohol ester-exchange liquid. Thereafter, they were further mixed by the ball mill for 200 hours for disassociating the associated particles, to thereby obtain a toner particle dispersion liquid.

After the completion of the disassociation process, 225 parts by weight of soy oil (produced by The Nisshin OilliO Group, Ltd.) and 1.4 parts by weight of zinc oxide (an average particles size of zinc oxide was 2.0 μm) as a charge control agent were added to the vessel, so that an insulation liquid in which the toner particles were dispersed was obtained.

The dispersion of the toner particles was carried out by a ball mill using beads having a diameter of 1 mm for 24 hours, and then the beads were removed. In this way, a liquid developer was obtained.

In the thus obtained liquid developer, an average particle size of the toner particles was 1.3 μm, and a standard deviation of the particle size between the toner particles was 0.50 μm. Further, a viscosity of the liquid developer measured by using a vibration type viscometer at a temperature of 25° C. according to JIS Z 8809 was 190 mPa·s.

Further, an electric resistance of the insulation liquid was $8.0\times10^{12}$ Ωcm, and an electric resistance of the liquid developer was $2.1\times10^{12}$ Ωcm.

Example 19

In Example 19, a liquid developer was produced in the same manner as in the Example 18 except that "soy oil fatty acid ethyl" (produced by The Nisshin OilliO Group, Ltd.) obtained by an ester-exchange reaction of soy oil and ethanol was used as the soy oil-alcohol ester-exchange liquid.

Example 20

In Example 20, a liquid developer was produced in the same manner as in the Example 18 except that "soy oil fatty acid buthyl" (produced by The Nisshin OilliO Group, Ltd.) obtained by an ester-exchange reaction of soy oil and buthanol was used as the soy oil-alcohol ester-exchange liquid.

Example 21

In Example 21, a liquid developer was produced in the same manner as in the Example 18 except that the charge control agent was changed to that shown in Table 5.

Example 22

In Examples 22, a liquid developer was produced in the same manner as in the Example 18 except that epoxy resin ("EPIKOTE 1004", softening point $T_f$ thereof was 128° C.) was used instead of polyester resin.

A liquid developer was produced in the same manner as in the Comparative Example 1 to 4.

For the Examples 18 to 22 and the Comparative Examples 1 to 4, the kinds of resins, vegetable oils and vegetable oil-alcohol ester-exchange liquids used, the amounts of the vegetable oil and the vegetable oil-alcohol ester-exchange liquid contained in each insulation liquid, the electric resistance of each insulation liquid, and the viscosity of each liquid developer and the like were shown in Table 5. Note that in the Table 5 "PEs" represents polyester resin.

TABLE 5

| | Liquid developer | | | | | | | |
|---|---|---|---|---|---|---|---|---|
| | | Insulation liquid | | | | | | |
| | | Vegetable oil | | | Vegetable oil-alcohol ester-exchange liquid | | | |
| | Resin | Kind | Amount of oleic acid [mol %] | Amount of vegetable oil in insulation liquid: X [wt %] | Vegetable oil | Alcohol | Amount of oleic acid [mol %] | Amount of vegetable oil-alcohol ester-exchange liquid in insulation liquid: Y [wt %] |
| Ex. 18 | PEs | Soy oil | — | 60 | Soy oil | Methanol (carbon number 1) | — | 40 |
| Ex. 19 | PEs | Soy oil | — | 60 | Soy oil | Ethanol (carbon number 2) | — | 40 |
| Ex. 20 | PEs | Soy oil | — | 60 | Soy oil | Butanol (carbon number 4) | — | 40 |
| Ex. 21 | PEs | Soy oil | — | 60 | Soy oil | Methanol (carbon number 1) | — | 40 |

TABLE 5-continued

| | | | | | | | | |
|---|---|---|---|---|---|---|---|---|
| Ex. 22 | EP | Soy oil | — | 60 | Soy oil | Methanol (carbon number 1) | — | 40 |
| Comp. Ex. 1 | PEs | Soy oil | — | 100 | — | — | — | — |
| Comp. Ex. 2 | PEs | — | — | — | Soy oil | Methanol (carbon number 1) | — | 100 |
| Comp. Ex. 3 | PEs | Soy oil | — | 100 | — | — | — | — |
| Comp. Ex. 4 | PEs | — | — | — | Soy oil | Methanol (carbon number 1) | — | 100 |

| | Liquid developer | | | | | | |
|---|---|---|---|---|---|---|---|
| | Insulation liquid | | Charge control agent | | Existence of condensation | | |
| | X/Y | Electric resistance [Ωcm] | Kind | Average particle size [μm] | polymer of polyamine fatty acid | viscosity [mPa · S] | Electric resistance [Ωcm] |
| Ex. 18 | 0.67 | $8.0 \times 10^{12}$ | ZnO | 2.0 | Yes | 190 | $2.1 \times 10^{12}$ |
| Ex. 19 | 1.5 | $8.0 \times 10^{12}$ | ZnO | 2.0 | Yes | 191 | $2.1 \times 10^{12}$ |
| Ex. 20 | 1.5 | $8.0 \times 10^{12}$ | ZnO | 2.0 | Yes | 190 | $2.2 \times 10^{12}$ |
| Ex. 21 | 1.5 | $8.0 \times 10^{12}$ | $Al_2O_3$ | 2.0 | Yes | 192 | $2.1 \times 10^{12}$ |
| Ex. 22 | 1.5 | $8.0 \times 10^{12}$ | ZnO | 2.0 | Yes | 190 | $2.3 \times 10^{12}$ |
| Comp. Ex. 1 | — | $1.2 \times 10^{13}$ | ZnO | 2.0 | No | 490 | $3.1 \times 10^{12}$ |
| Comp. Ex. 2 | — | $2.0 \times 10^{12}$ | ZnO | 2.0 | No | 40 | $5.3 \times 10^{11}$ |
| Comp. Ex. 3 | — | $1.2 \times 10^{13}$ | ZnO | 2.0 | Yes | 505 | $3.1 \times 10^{12}$ |
| Comp. Ex. 4 | — | $2.0 \times 10^{12}$ | ZnO | 2.0 | Yes | 45 | $5.3 \times 10^{11}$ |

<6> Evaluation

For the respective liquid developers produced as described above, the same evaluations as those for the above-described <4> were made. In addition, the following evaluation <6.1> was also made.

<6.1> Color Reproducibility

By using the image forming apparatus shown in FIG. 1 images each having a predetermined pattern were formed on recording papers (High quality paper LPCPPA4 produced by Seiko Epson Corporation) employing the liquid developers of the Examples 18 to 22 and the Comparative Examples 1 to 4, respectively. Then, the images formed on the papers were thermally fixed onto the papers using a fixing apparatus as shown in FIG. 3. The thermal fixing was carried out by setting a temperature of a heat fixing roller at 100° C.

First, a criteria sample formed using a liquid developer having a good dispersion state of toner particles was produced. Next, for the samples formed using the liquid developers of the Examples 18 to 22, the Comparative Examples 1 to 4, and the criteria sample, hues were measured by a calorimeter (produced by X-Rite Ltd.), and ΔEs (color difference), that is a distance between each of the hues of the Examples 18 to 22 and the Comparative Examples 1 to 4 and the hue of the criteria sample in USC color space were calculated. The results were evaluated according to the following four criteria.

A: ΔE was lower than 4.

B: ΔE was 4 or higher but lower than 7.

C: ΔE was 7 or higher but lower than 10.

D: ΔE was 10 or higher.

The results are shown in Table 6.

TABLE 6

| | Evaluation | | | | | | |
|---|---|---|---|---|---|---|---|
| | Fixing strength | Gloss | Color reproducibility | Dispersion stability | Preservability | Environmental stability | Peel strength |
| Ex. 18 | A | A | A | A | A | A | A |
| Ex. 19 | A | A | A | A | A | A | A |
| Ex. 20 | A | A | A | A | A | A | A |
| Ex. 21 | A | A | A | A | A | A | A |
| Ex. 22 | B | B | B | B | B | A | B |
| Comp. Ex. 1 | D | C | D | C | E | D | D |

TABLE 6-continued

| | Evaluation | | | | | | |
|---|---|---|---|---|---|---|---|
| | Fixing strength | Gloss | Color reproducibility | Dispersion stability | Preservability | Environmental stability | Peel strength |
| Comp. Ex. 2 | E | D | B | C | D | C | D |
| Comp. Ex. 3 | D | C | C | C | E | D | D |
| Comp. Ex. 4 | E | D | D | C | D | C | D |

As shown in the Table 6, the liquid developers of the invention (that is, the liquid developers of the Examples 18 to 22) had excellent fixing strength, excellent gloss level of images formed on the recording paper, and excellent color reproducibility.

Further, the liquid developers of the invention had excellent dispersion stability, excellent preservability, excellent environmental stability (storage stability), and excellent peel strength. In contrast, in the liquid developers of the Comparative Examples 1 to 4, satisfactory results could not be obtained.

The cross section of the recording paper on which an image was formed using the liquid developer of each of the Examples 18 to 22 was observed by a scanning electron microscope, and as a result, it was observed that the toner particles were entered into the spaces of the paper fibers of the recording paper as is the same with the recorded toner images of the Examples 1 to 17.

Furthermore, liquid developers which are the same as those described above were produced excepting that as a coloring agent a pigment red 122, a pigment yellow 180, and a carbon black ("Printex L", produced by Degussa AG) were used instead of the cyanogen-based pigment, and they were evaluated in the same manner as described above. As a result, substantially the same results could be obtained.

<7> Production of Liquid Developer

Example 23

First, 80 parts by weight of a polyester resin (softening point $T_f$ thereof was 99° C.), and 20 parts by weight of a cyanine pigment ("Pigment Blue 15:3", produced by Dainichiseika Color & Chemicals Mfg. Co., Ltd.) as a coloring agent were prepared. These components were mixed using a 20 L type Henschel mixer to obtain a material for producing toner particles.

Next, the material (mixture) was kneaded using a biaxial kneader-extruder. The kneaded material extruded from an extruding port of the biaxial kneader-extruder was cooled. The kneaded material that had been cooled as described above was coarsely ground using a hammer mill to be formed into powder (ground material) having an average particle size of 1.0 mm or less.

Next, 250 parts by weight of toluene was added to 100 parts by weight of the coarse kneaded material, and then it was subjected to a treatment using an ultrasound homogenizer (output: 400 μA) for one hour to obtain a solution (toner material solution) in which the polyester resin of the kneaded material was dissolved. In the solution, the pigment was finely dispersed homogeneously.

Further, 1 part by weight of sodium-dodecylbenzenesulfonic acid as a dispersant was mixed with 700 parts by weight of ion-exchanged water to obtain a water-based liquid. The water-based liquid was stirred with a homomixer (produced by PRIMIX Corporation) with the number of stirring being adjusted.

The above toner material solution was added drop by drop to the water-based liquid with being stirred, to obtain a water-based emulsion in which a dispersoid comprised of particles having an average particle size of 0.5 μm was homogeneously dispersed.

Thereafter, the toluene contained in the water-based emulsion was removed under the conditions in which a temperature was 100° C. and an ambience pressure was 80 kPa, and after it was cooled to room temperature, a predetermined amount of water was added for condensation adjustment to thereby obtain a water-based dispersion liquid in which solid fine particles were dispersed. In the thus obtained water-based dispersion liquid, substantially no toluene remained.

The concentration of the solid component (dispersoid) of the thus obtained water-based dispersion liquid was 20 wt %. Further, the average particle size of the particles of the dispersoid (solid fine particles) dispersed in the suspension was 0.5 μm.

The measurement of the average particle size was carried out using a laser diffraction/scattering type particle size distribution measurement apparatus ("LA-920", produced by HORIBA Ltd.).

Next, 0.35 parts by weight of nonionic surfactant ("EPAN 450" produced by DAI-ICHI KOGYO SEIYAKU CO., LTD) was added to 100 parts by weight of the thus obtained water-based dispersion liquid with being stirred.

Next, a stirring speed was adjusted, and a temperature was set to 30° C. Thereafter, 35 parts by weight of a 3% ammonium sulfate solution was added drop by drop to 100 parts by the weight of water-based dispersion liquid. In this way, an associated particle dispersion liquid in which associated particles were dispersed was obtained.

The associated particles were separated by a centrifugal machine from the thus obtained the associated particle dispersion liquid. Then, the associated particles were washed. Thereafter, the associated particles were dried by a vacuum dryer to thereby obtain the associated particles. An average particle size of the thus obtained associated particles was 5.2 μm.

Next, chromium carbide beads having an average diameter of 4 mm were prepared in a vessel of 500 mL. Thereafter, 150 parts by weight of rape oil-alcohol ester-exchange liquid ("rape oil fatty acid methyl" produced by The Nisshin OilliO Group, Ltd.) obtained by an ester-exchange reaction of rape oil and methanol, and 2.5 parts by weight of the condensation polymer of polyamine fatty acid as a dispersant ("Solsperse 139401" produced by Lubrizol Japan Ltd.) were put in the vessel. Further, an amount of oleic acid component contained in the rape oil-alcohol ester-exchange liquid was 80 mol %.

Next, 100 parts by weight of the thus obtained associated particles were put in the vessel. The associated particles, the chromium carbide beads, the rape oil-alcohol ester-exchange liquid and the condensation polymer of polyamine fatty acid were mixed by a ball mill for 10 minutes for blending the associated particles with the rape oil-alcohol ester-exchange liquid. Thereafter, they were further mixed by the ball mill for 200 hours for disassociating the associated particles, to thereby obtain a toner particle dispersion liquid.

After the completion of the disassociation process, 225 parts by weight of rape oil (produced by The Nisshin Oillio Group, Ltd.) and 1.4 parts by weight of zinc oxide (an average particles size of zinc oxide was 2.0 μm) as a charge control agent were added to the vessel, so that an insulation liquid in which the toner particles were dispersed was obtained.

The dispersion of the toner particles was carried out by a ball mill using beads having a diameter of 1 mm for 24 hours, and then the beads were removed. In this way, a liquid developer was obtained.

In the thus obtained liquid developer, an average particle size of the toner particles was 1.4 μm, and a standard deviation of the particle size between the toner particles was 0.70 μm. Further, a viscosity of the liquid developer measured by using a vibration type viscometer at a temperature of 25° C. according to JIS Z 8809 was 273 mPa·s.

An electric resistance of the insulation liquid was $2.5\times10^{13}$ Ωcm, and an electric resistance of the liquid developer was $5.4\times10^{12}$ Ωcm. Further, an amount of oleic acid component contained in the rape oil was 80 mol %.

Examples 24 and 25

In each of Examples 24 and 25, a liquid developer was produced in the same manner as in the Example 23 except that the amount of the rape oil-alcohol ester-exchange liquid and the amount of the rape oil were changed to those shown in Table 7.

Examples 26

In Example 26, a liquid developer was produced in the same manner as in the Example 23 except that an amount of oleic acid component contained in rape oil was 60 mol % (produced by The Nisshin OilliO Group, Ltd.), and an amount of oleic acid component contained in rape oil-alcohol ester-exchange liquid was 60 mol % (produced by The Nisshin OilliO Group, Ltd.).

Example 27

In Examples 27, a liquid developer was produced in the same manner as in the Example 23 except that epoxy resin ("EPIKOTE 1004", softening point $T_f$ thereof was 128° C.) was used instead of polyester resin.

A liquid developer was produced in the same manner as in the Comparative Example 1 to 4.

For the Examples 23 to 27 and the Comparative Examples 1 to 4, the kinds of resins, vegetable oils and vegetable oil-alcohol ester-exchange liquids used, the amounts of the vegetable oil and the vegetable oil-alcohol ester-exchange liquid contained in each insulation liquid, the electric resistance of each insulation liquid, and the viscosity of each liquid developer and the like were shown in Table 7. Note that in the Table 7 "PEs" represents polyester resin.

TABLE 7

| | Liquid developer | | | | | | | | |
|---|---|---|---|---|---|---|---|---|---|
| | | Insulation liquid | | | | | | | |
| | | Vegetable oil | | | Vegetable oil-alcohol ester-exchange liquid | | | | |
| | Resin | Kind | Amount of oleic acid [mol %] | Amount of vegetable oil in insulation liquid: X [wt %] | Vegetable oil | Alcohol | Amount of oleic acid [mol %] | Amount of vegetable oil-alcohol ester-exchange liquid in insulation liquid: Y [wt %] |
| Ex. 23 | PEs | Rape oil | 80 | 60 | Rape oil | Methanol (carbon number 1) | 80 | 40 |
| Ex. 24 | PEs | Rape oil | 80 | 55 | Rape oil | Methanol (carbon number 1) | 80 | 45 |
| Ex. 25 | PEs | Rape oil | 80 | 40 | Rape oil | Methanol (carbon number 1) | 80 | 60 |
| Ex. 26 | PEs | Rape oil | 60 | 60 | Rape oil | Methanol (carbon number 1) | 60 | 60 |
| Ex. 27 | EP | Rape oil | 80 | 60 | Rape oil | Methanol (carbon number 1) | 80 | 40 |
| Comp. Ex. 1 | PEs | Soy oil | — | 100 | — | — | — | — |
| Comp. Ex. 2 | PEs | — | — | — | Soy oil | Methanol (carbon number 1) | — | 100 |

TABLE 7-continued

| | | | | | | | | |
|---|---|---|---|---|---|---|---|---|
| Comp. Ex. 3 | PEs | Soy oil | — | 100 | — | — | — | — |
| Comp. Ex. 4 | PEs | — | — | — | Soy oil | Methanol (carbon number 1) | — | 100 |

| | Liquid developer | | | | | | |
|---|---|---|---|---|---|---|---|
| | Insulation liquid | | Charge control agent | | Existence of condensation | | |
| | X/Y | Electric resistance [Ωcm] | Kind | Average particle size [μm] | polymer of polyamine fatty acid | viscosity [mPa · S] | Electric resistance [Ωcm] |
| Ex. 23 | 1.5 | $2.5 \times 10^{13}$ | ZnO | 2.0 | Yes | 273 | $5.4 \times 10^{12}$ |
| Ex. 24 | 1.22 | $2.3 \times 10^{13}$ | ZnO | 2.0 | Yes | 239 | $5.0 \times 10^{12}$ |
| Ex. 25 | 0.67 | $1.7 \times 10^{13}$ | ZnO | 2.0 | Yes | 166 | $3.7 \times 10^{12}$ |
| Ex. 26 | 1.5 | $2.4 \times 10^{13}$ | ZnO | 2.0 | Yes | 274 | $5.2 \times 10^{12}$ |
| Ex. 27 | 1.5 | $2.5 \times 10^{13}$ | ZnO | 2.0 | Yes | 273 | $5.3 \times 10^{12}$ |
| Comp. Ex. 1 | — | $1.2 \times 10^{13}$ | ZnO | 2.0 | No | 490 | $3.1 \times 10^{12}$ |
| Comp. Ex. 2 | — | $2.0 \times 10^{12}$ | ZnO | 2.0 | No | 40 | $5.3 \times 10^{11}$ |
| Comp. Ex. 3 | — | $1.2 \times 10^{13}$ | ZnO | 2.0 | Yes | 505 | $3.1 \times 10^{12}$ |
| Comp. Ex. 4 | — | $2.0 \times 10^{12}$ | ZnO | 2.0 | Yes | 45 | $5.3 \times 10^{11}$ |

<8> Evaluation

For the respective liquid developers produced as described above, the same evaluations as those for the above-described <1> and <6.1> were made. The results are shown in Table B.

Examples 23 to 27 was observed by a scanning electron microscope, and as a result, it was observed that the toner particles were entered into the spaces of the paper fibers of the recording paper as is the same with the recorded toner images of the Examples 1 to 22.

TABLE 8

| | Evaluation | | | | | | |
|---|---|---|---|---|---|---|---|
| | Fixing strength | Charge property | Color reproducibility | Dispersion stability | Preservability | Environmental stability | Peel strength |
| Ex. 23 | A | A | A | A | A | A | A |
| Ex. 24 | A | A | A | A | A | A | A |
| Ex. 25 | A | A | A | A | B | A | A |
| Ex. 26 | A | C | B | B | B | B | A |
| Ex. 27 | B | B | B | B | B | A | B |
| Comp. Ex. 1 | D | E | D | C | E | D | D |
| Comp. Ex. 2 | E | E | B | C | D | C | D |
| Comp. Ex. 3 | D | D | C | C | E | D | D |
| Comp. Ex. 4 | E | E | D | C | D | C | D |

As shown in the Table 8, the liquid developers of the invention (that is, the liquid developers of the Examples 23 to 27) had excellent fixing strength, excellent charge property, and excellent color reproducibility.

Further, the liquid developers of the invention had excellent dispersion stability, excellent preservability, excellent environmental stability (storage stability), and excellent peel strength. In contrast, in the liquid developers of the Comparative Examples 1 to 4, satisfactory results could not be obtained.

The cross section of the recording paper on which an image was formed using the liquid developer of each of the Furthermore, liquid developers which are the same as those described above were produced excepting that as a coloring agent a pigment red 122, a pigment yellow 180, and a carbon black ("Printex L", produced by Degussa AG) were used instead of the cyanogen-based pigment, and they were evaluated in the same manner as described above. As a result, substantially the same results could be obtained.

What is claimed is:

1. A liquid developer which comprises an insulation liquid and toner particles dispersed in the insulation liquid, wherein the insulation liquid comprises a first vegetable oil and a reaction product produced by an ester exchange reaction of a second vegetable oil and a monovalent alcohol.

2. The liquid developer as claimed in claim 1, wherein the kind of the second vegetable oil is different from the kind of the first vegetable oil.

3. The liquid developer as claimed in claim 2, wherein the first vegetable oil is rape oil and the second vegetable oil is soy oil.

4. The liquid developer as claimed in claim 2, wherein the first vegetable oil is soy oil and the second vegetable oil is rape oil.

5. The liquid developer as claimed in claim 1, wherein the insulation liquid further contains a dispersant comprised of a condensation polymer of polyamine fatty acid.

6. The liquid developer as claimed in claim 5, wherein an amount of the condensation polymer of polyamine fatty acid is 0.5 to 7.5 parts by weight with respect to 100 parts by weight of the toner particles.

7. The liquid developer as claimed in claim 1, wherein the first vegetable oil and the second vegetable oil are the same kind vegetable oil, and the insulation liquid further contains a condensation polymer of polyamine fatty acid as a dispersant.

8. The liquid developer as claimed in claim 7, wherein both the first and second vegetable oils are soy oil.

9. The liquid developer as claimed in claim 7, wherein both the first and second vegetable oils are rape oil.

10. The liquid developer as claimed in claim 1, wherein when an amount of the first vegetable oil contained in the insulation liquid is defined as X wt % and an amount of the reaction product is defined as Y wt %, the relation: $0.1 \leqq X/Y \leqq 9$ is satisfied.

11. The liquid developer as claimed in claim 1, wherein the reaction product is produced by an ester exchange reaction of the second vegetable oil and a monovalent alcohol having 1 to 4 carbon atoms.

12. The liquid developer as claimed in claim 1, wherein the viscosity of the liquid developer which is measured according to JIS Z8809 using a vibration type viscometer at a temperature of 25° C. is in the range of 50 to 1000 mPa·s.

13. The liquid developer as claimed in claim 1, wherein a resin material which constitutes the toner particles is polyester resin.

14. The liquid developer as claimed in claim 1, wherein the insulation liquid further contains a metal oxide, and an amount of the metal oxide is 0.5 to 4.0 parts by weight with respect to 100 parts by weight of the toner particles.

15. An image forming apparatus, comprising:

a plurality of developing sections for forming a plurality of monochromatic color images using a plurality of liquid developers of different colors;

an intermediate transfer section to which a plurality of monochromatic color images formed by the developing sections are sequentially transferred to form an intermediate transfer image which is formed by overlaying the transferred monochromatic color images one after another;

a secondary transfer section for transferring the intermediate transfer image onto a recording medium to form an unfixed image onto the recording medium, and a fixing device for fixing the unfixed image onto the recording medium, wherein each of the liquid developers of the different colors comprises an insulation liquid and toner particles dispersed in the insulation liquid, wherein the insulation liquid comprising a first vegetable oil and a reaction product produced by an ester exchange reaction of a second vegetable oil and a monovalent alcohol.

16. The image forming apparatus as claimed in claim 15, wherein each of the plurality of developing sections includes a developing roller having a surface on which a layer of the liquid developer is to be formed, and a photoreceptor having a surface on which the corresponding monochromatic color image is to be formed by transferring the liquid developer on the developing roller, wherein the surface of the photoreceptor is formed of amorphous silicon.

* * * * *